US012577071B2

(12) United States Patent
Takahashi et al.

(10) Patent No.: US 12,577,071 B2
(45) Date of Patent: Mar. 17, 2026

(54) SHEET CONVEYANCE APPARATUS AND IMAGE FORMING APPARATUS

(71) Applicant: CANON KABUSHIKI KAISHA, Tokyo (JP)

(72) Inventors: Wataru Takahashi, Chiba (JP); So Matsumoto, Saitama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 177 days.

(21) Appl. No.: 18/449,084

(22) Filed: Aug. 14, 2023

(65) Prior Publication Data

US 2024/0059518 A1 Feb. 22, 2024

(30) Foreign Application Priority Data

Aug. 22, 2022 (JP) ..... 2022-132012

(51) Int. Cl.
*B65H 9/16* (2006.01)
*B65H 7/10* (2006.01)

(52) U.S. Cl.
CPC ..... *B65H 9/166* (2013.01); *B65H 7/10* (2013.01); *B65H 2404/1424* (2013.01); *B65H 2404/1441* (2013.01); *B65H 2404/742* (2013.01); *B65H 2511/20* (2013.01); *B65H 2511/414* (2013.01); *B65H 2801/06* (2013.01)

(58) Field of Classification Search
CPC .. B65H 9/166; B65H 7/10; B65H 2404/1424; B65H 2404/742
See application file for complete search history.

(56) References Cited

U.S. PATENT DOCUMENTS 6,273,418 B1 * 8/2001 Fujikura ..... B65H 9/103 271/227
10,160,237 B2 * 12/2018 Herrmann ..... B65H 9/16
11,924,387 B2 * 3/2024 Egawa ..... B65H 7/10
2022/0002104 A1 * 1/2022 Matsumoto ..... B65H 9/103

FOREIGN PATENT DOCUMENTS

JP 2022013356 A 1/2022

* cited by examiner

*Primary Examiner* — Patrick Cicchino
(74) *Attorney, Agent, or Firm* — ROSSI, KIMMS & McDOWELL LLP

(57) ABSTRACT

A sheet conveyance apparatus includes a rotary member pair, a moving unit configured to move the rotary member pair in a width direction orthogonal to a sheet conveyance direction, an abutment member, an obliquely conveying portion, a detection portion, and a control unit. The control unit is configured to execute (1) a first mode of controlling the moving unit such that the rotary member pair is moved in the width direction based on a detection result of the detection portion before the sheet arrives at the obliquely conveying portion, and (2) a second mode of controlling the moving unit such that the rotary member pair is moved in a second direction regardless of a detection result of the detection portion in a state where the sheet is nipped by the rotary member pair and before the sheet arrives at the obliquely conveying portion.

21 Claims, 22 Drawing Sheets

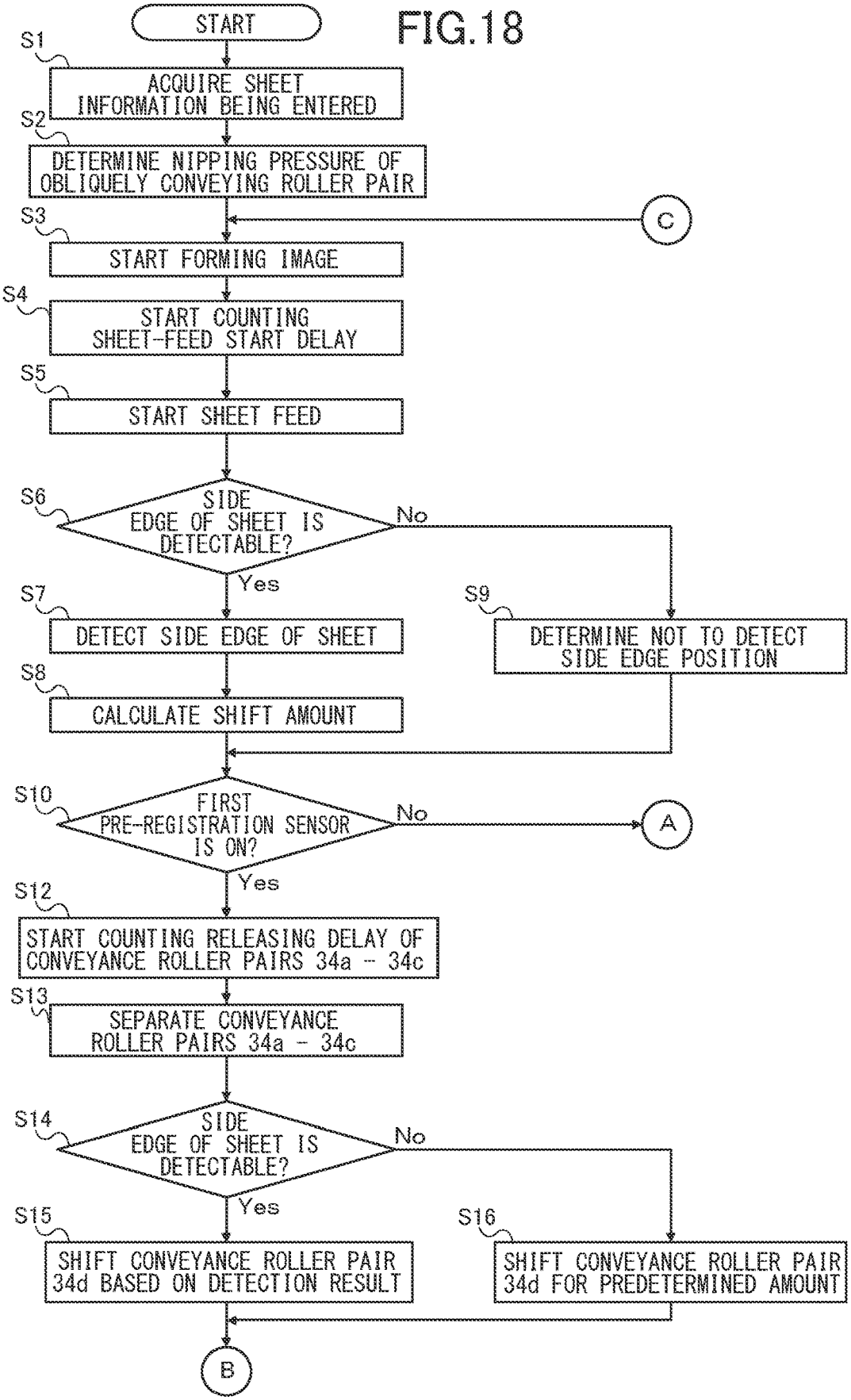
FIG.18
START
S1
ACQUIRE SHEET INFORMATION BEING ENTERED
S2
DETERMINE NIPPING PRESSURE OF OBLIQUELY CONVEYING ROLLER PAIR
C
S3
START FORMING IMAGE
S4
START COUNTING SHEET-FEED START DELAY
S5
START SHEET FEED
S6
SIDE EDGE OF SHEET IS DETECTABLE?
No
Yes
S7
DETECT SIDE EDGE OF SHEET
S9
DETERMINE NOT TO DETECT SIDE EDGE POSITION
S8
CALCULATE SHIFT AMOUNT
S10
FIRST PRE-REGISTRATION SENSOR IS ON?
No
A
Yes
S12
START COUNTING RELEASING DELAY OF CONVEYANCE ROLLER PAIRS 34a - 34c
S13
SEPARATE CONVEYANCE ROLLER PAIRS 34a - 34c
S14
SIDE EDGE OF SHEET IS DETECTABLE?
No
Yes
S15
SHIFT CONVEYANCE ROLLER PAIR 34d BASED ON DETECTION RESULT
S16
SHIFT CONVEYANCE ROLLER PAIR 34d FOR PREDETERMINED AMOUNT
B

SHEET CONVEYANCE APPARATUS AND IMAGE FORMING APPARATUS

BACKGROUND OF THE INVENTION

Field of the Invention

The present invention relates to a sheet conveyance apparatus for conveying sheets, and an image forming apparatus for forming images on sheets.

Description of the Related Art

Japanese Patent Application Laid-Open Publication No. 2022-13356 proposes an image forming apparatus that corrects skewing of sheets during conveyance, i.e., performs skew correction of sheets, by conveying the sheet using an obliquely conveying roller such that an edge portion in a width direction orthogonal to a conveyance direction of the sheet is aligned along a reference guide. The image forming apparatus detects the position of an edge portion of the sheet in a width-direction by a detection apparatus before correcting skewing of the sheet using the obliquely conveying roller and the reference guide, and adjusts the width-direction position of the sheet using a detection result thereof.

According to the image forming apparatus disclosed in Japanese Patent Application Laid-Open Publication No. 2022-13356, in a case where a transparent sheet, such as an OHP film, is conveyed, the detection apparatus cannot detect the width-direction edge portion of the sheet, such that the width-direction position of the sheet cannot be adjusted before performing skew correction of the sheet. Therefore, the width-direction position of the sheet prior to skew correction was dispersed, and there was a risk that a leading edge of the sheet in the conveyance direction collided against the reference guide.

SUMMARY OF THE INVENTION

According to a first aspect of the present invention, a sheet conveyance apparatus includes a rotary member pair configured to nip and convey a sheet in a sheet conveyance direction, a moving unit configured to move the rotary member pair, nipping the sheet, in a width direction orthogonal to the sheet conveyance direction, the width direction including a first direction from one side in the width direction toward the other side, and a second direction which is opposite to the first direction, an abutment member arranged downstream of the rotary member pair in the sheet conveyance direction, the abutment member including an abutment surface that extends along the sheet conveyance direction and that is configured to be in contact with a downstream edge of the sheet in the first direction, an obliquely conveying portion that is arranged downstream of the rotary member pair in the sheet conveyance direction and that conveys the sheet in the first direction while conveying the sheet in the sheet conveyance direction such that the downstream edge approaches the abutment surface, a detection portion that is arranged upstream of the obliquely conveying portion in the sheet conveyance direction and that detects a position of the downstream edge, and a control unit configured to control the moving unit. The control unit is configured to execute (1) a first mode of controlling the moving unit such that the rotary member pair is moved in the width direction based on a detection result of the detection portion in a state where the sheet is nipped by the rotary member pair and before the sheet arrives at the obliquely conveying portion, and (2) a second mode of controlling the moving unit such that the rotary member pair is moved in the second direction regardless of a detection result of the detection portion in a state where the sheet is nipped by the rotary member pair and before the sheet arrives at the obliquely conveying portion.

According to a second aspect of the present invention, a sheet conveyance apparatus includes a rotary member pair configured to nip and convey a sheet in a sheet conveyance direction, a first moving unit configured to move the rotary member pair, nipping the sheet, in a width direction orthogonal to the sheet conveyance direction, the width direction including a first direction from one side in the width direction toward the other side, and a second direction which is opposite to the first direction, an abutment member arranged downstream of the rotary member pair in the sheet conveyance direction, the abutment member including an abutment surface that extends along the sheet conveyance direction and that is configured to be in contact with a downstream edge of the sheet in the first direction, a second moving unit configured to move the abutment member in the width direction, an obliquely conveying portion that is arranged downstream of the rotary member pair in the sheet conveyance direction and that conveys the sheet in the first direction while conveying the sheet in the sheet conveyance direction such that the downstream edge approaches the abutment surface, a detection portion that is arranged upstream of the obliquely conveying portion in the sheet conveyance direction and that detects a position of the downstream edge, and a control unit configured to control the first moving unit and the second moving unit. The control unit is configured to execute (1) a third mode of controlling the first moving unit such that the rotary member pair is moved in the width direction based on a detection result of the detection portion in a state where the sheet is nipped by the rotary member pair and before the sheet arrives at the obliquely conveying portion, and (2) a fourth mode of controlling the second moving unit such that the abutment member is moved in the first direction regardless of a detection result of the detection portion before the sheet reaches the obliquely conveying portion.

According to a third aspect of the present invention, a sheet conveyance apparatus includes a rotary member pair configured to nip and convey a sheet in a sheet conveyance direction, a first moving unit configured to move the rotary member pair, nipping the sheet, in a width direction orthogonal to the sheet conveyance direction, the width direction including a first direction from one side in the width direction toward the other side, and a second direction which is opposite to the first direction, an abutment member arranged downstream of the rotary member pair in the sheet conveyance direction, the abutment member including an abutment surface that extends along the sheet conveyance direction and that is configured to be in contact with a downstream edge of the sheet in the first direction, a second moving unit configured to move the abutment member in the width direction, an obliquely conveying portion that is arranged downstream of the rotary member pair in the sheet conveyance direction and that conveys the sheet in the first direction while conveying the sheet in the sheet conveyance direction such that the downstream edge approaches the abutment surface, a detection portion that is arranged upstream of the obliquely conveying portion in the sheet conveyance direction and that detects a position of the downstream edge, and a control unit configured to execute, before the sheet arrives at the obliquely conveying portion, (1) a first processing of controlling the first moving unit such that the rotary member pair, nipping the sheet, is moved in the width direction based on a detection result of the detection portion, (2) a second processing of controlling the second moving unit such that the abutment member is moved in the width direction based on the detection result of the detection portion, (3) a third processing of controlling the first moving unit such that the rotary member pair, nipping the sheet, is moved in the second direction regardless of the detection result of the detection portion, and (4) a fourth processing of controlling the second moving unit such that the abutment member is moved in the first direction regardless of the detection result of the detection portion. The control unit is configured to execute a fifth mode in which at least either one of the first processing and the second processing is executed, and execute a sixth mode in which at least either one of the third processing and the fourth processing is executed.

Further features of the present invention will become apparent from the following description of exemplary embodiments with reference to the attached drawings.

BRIEF DESCRIPTION OF THE DRAWINGS

FIG. 18 is a flowchart illustrating a control processing of a case where a CPU of a printing apparatus according to the first embodiment executes registration correction and skew correction.

DESCRIPTION OF THE EMBODIMENTS

First Embodiment

Now, a first embodiment of the present invention will be described in detail with reference to FIGS. 1 to 19.

Configuration of Image Forming Apparatus

Full-color image forming apparatuses are classified into a tandem system in which a plurality of process cartridges are arranged in a row and a rotary system in which a plurality of process cartridges are arranged cylindrically. Further, image forming apparatuses are classified by transfer methods into a direct transfer system in which a toner image is directly transferred from a photosensitive member to a sheet and an intermediate transfer system in which the toner image is temporarily transferred to an intermediate transfer belt before being transferred onto the sheet. The intermediate transfer system does not require sheets to be placed on a transfer drum or a transfer belt as in the case of the direct transfer system, and it can cope with various types of paper, such as super-thick paper and coated paper, and it is suitable for realizing high productivity through parallel processing in a plurality of image forming units and collective transfer of full-color images.

Figure 1:
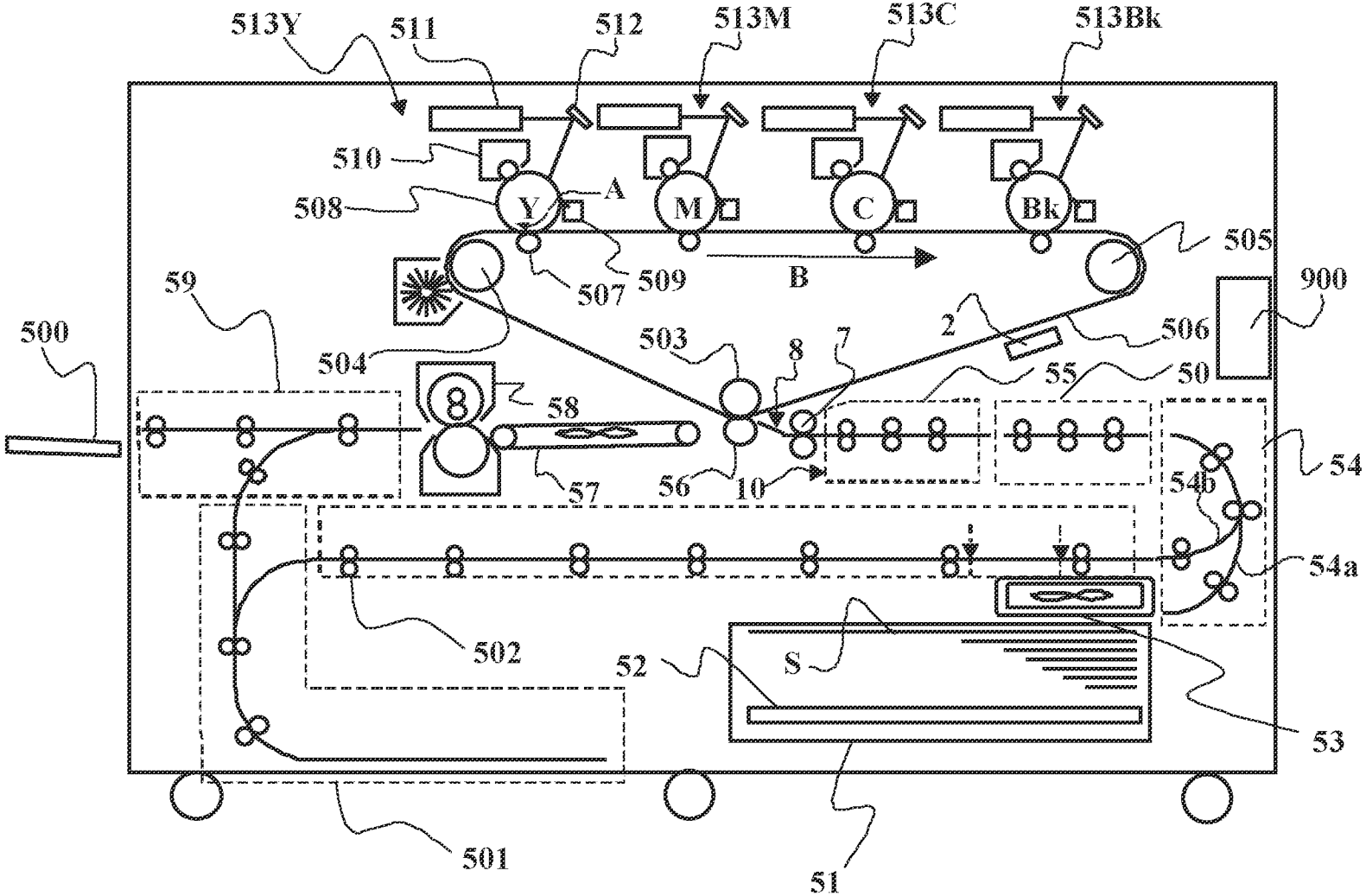
FIG. 1 is a schematic drawing of an image forming apparatus according to a first embodiment.

FIG. 1 is a cross-sectional view illustrating an intermediate transfer, tandem-type image forming apparatus 1 in which image forming units 513 that form toner images of four colors are aligned on an intermediate transfer belt 506. As illustrated in FIG. 1, a sheet S is stored in a stacked manner on a lifting apparatus 52 provided in a sheet feeding apparatus 51, and sheets are fed by a sheet feeding unit 53 at a matched timing with an image forming timing of the image forming apparatus 1.

The sheet feeding unit 53 adopts, for example, a friction separation system that uses a sheet feed roller or a suction separation system that uses air. The sheet feeding unit 53 provided in the image forming apparatus 1 illustrated in FIG. 1 adopts a sheet feeding system that uses air.

The sheet S sent out by the sheet feeding unit 53 passes through a conveyance path 54*a* included in a conveyance unit 54 and a conveyance roller portion 50, conveyed to a skew feed correcting portion 55, subjected to skew correction and timing correction at the skew feed correcting portion 55, and thereafter, conveyed to a secondary transfer portion 40. The secondary transfer portion 40 is a transfer nip portion composed of a secondary transfer inner roller 503 and a secondary transfer outer roller 56 facing each other for transferring a toner image to a sheet, wherein a predetermined pressurizing force and an electrostatic load bias is applied to the sheet S to transfer the toner image to the sheet S.

Regarding the conveyance process of the sheet S to the secondary transfer portion 40 described above, an image forming process of the image sent at a similar timing to the secondary transfer portion 40 will be described. The image forming unit 513 includes four process cartridges 513Y, 513M, 513C, and 513Bk that form toner images of four colors, which are yellow (Y), magenta (M), cyan (C), and black (Bk). Further, the image forming apparatus 1 includes the intermediate transfer belt 506 that is wound around a tension roller 505, a driving roller 504, and the secondary transfer inner roller 503, and that is driven by the driving roller 504 to rotate in an arrow B direction. The four process cartridges 513Y, 513M, 513C, and 513Bk adopt a similar configuration except for the different colors of the images being formed. Therefore, the configuration and image forming process of only the process cartridge 513Y will be described, and the description of process cartridges 513M, 513C, and 513Bk will be omitted.

The process cartridge 513Y is composed of a photosensitive drum 508, an exposing unit 511, a developing unit 510, a primary transfer apparatus 507, and a cleaner 509. The photosensitive drum 508 is composed by applying an organic photoconductive layer on an outer circumference of an aluminum cylinder, and rotates in an arrow A direction by a drive motor. When an image signal is entered from a personal computer to the exposing unit 511, laser light corresponding to the image signal is irradiated from the exposing unit 511 to the photosensitive drum 508 of the process cartridge 513Y.

In this state, the surface of the photosensitive drum 508 is charged uniformly in advance by a charge roller to a predetermined polarity and potential, and an electrostatic latent image is formed on the surface thereof by having laser light irradiated thereto from the exposing unit 511 via a diffraction unit 512. The electrostatic latent image formed on the photosensitive drum 508 is developed by the developing unit 510, and a yellow (Y) toner image is formed on the photosensitive drum 508.

After having a toner image formed on the photosensitive drum 508, predetermined pressurizing force and electrostatic load bias are applied by the primary transfer apparatus 507, and a toner image is transferred to the intermediate transfer belt 506. Thereafter, a small amount of transfer residual toner remaining on the photosensitive drum 508 is collected by the cleaner 509 in the process cartridge 513Y so as to prepare for the next image forming process.

Similarly, laser light is irradiated from respective exposing units to respective photosensitive drums of process cartridges 513M, 513C, and 513Bk, and magenta (M), cyan (C), and black (Bk) toner images are formed on the respective photosensitive drums. The toner images of respective colors formed on each of the photosensitive drums are transferred to the intermediate transfer belt 506 by the respective primary transfer apparatuses. The image forming processes of respective colors subjected to parallel processing by the image forming unit 513 are carried out at a timing to superpose the image on a toner image that has been primarily transferred to the intermediate transfer belt 506 upstream thereof, such that a full-color toner image is formed on the intermediate transfer belt 506 and conveyed to the secondary transfer portion 40.

According to the conveyance process and the image forming process of the sheet S described above, in the image forming apparatus 1, a full-color toner image is primarily transferred to the sheet S at the secondary transfer portion 40. The sheet S to which the toner image has been secondarily transferred is conveyed via a pre-fixing sheet conveyance apparatus 57 to a fixing unit 58.

The fixing unit 58 melts and fixes toner on the sheet S by applying a predetermined pressurizing force from a roller or a belt opposed thereto and a heat from a heat source such as a heater. The sheet S having a fixed image obtained as above is conveyed to a sheet discharge tray 500 by a branch conveyance apparatus 59 in a case where an image is to be formed on one side of the sheet. If images are to be formed on both sides of the sheet S, the sheet S is conveyed by the branch conveyance apparatus 59 to a reverse conveyance apparatus 501 and is switched back. The sheet S that has been switched back is conveyed by the reverse conveyance apparatus 501 to a duplex conveyance unit 502 and guided to the conveyance unit 54. Thereafter, an image is formed on a second sheet surface, i.e., reverse side, of the sheet S at the secondary transfer portion 40, and the sheet S is conveyed to the sheet discharge tray 500.

Sheet Alignment Apparatus

The skew feed correcting portion 55 for correcting a positional deviation of the sheet S during conveyance is incorporated in a sheet alignment apparatus 10 serving as a sheet conveyance apparatus included in the image forming apparatus 1. The skew feed correcting portion 55 adopts a side-registration-type correction system in which an edge portion, i.e., side edge, in a width direction of the sheet S being conveyed that is orthogonal to the conveyance direction of the sheet S is used as reference to correct the positional deviation of the sheet S. In the first embodiment, the skew feed correcting portion 55 is arranged upstream of the secondary transfer portion 40 in a conveyance direction of the sheet S. The skew feed correcting portion 55 adopting the side registration system is not necessarily arranged upstream in the conveyance direction of the secondary transfer portion 40, and in a case where a sheet postprocessing apparatus is arranged downstream of the fixing unit 58 in the conveyance direction, the skew feed correcting portion 55 can be arranged in the sheet postprocessing apparatus.

Figure 2:
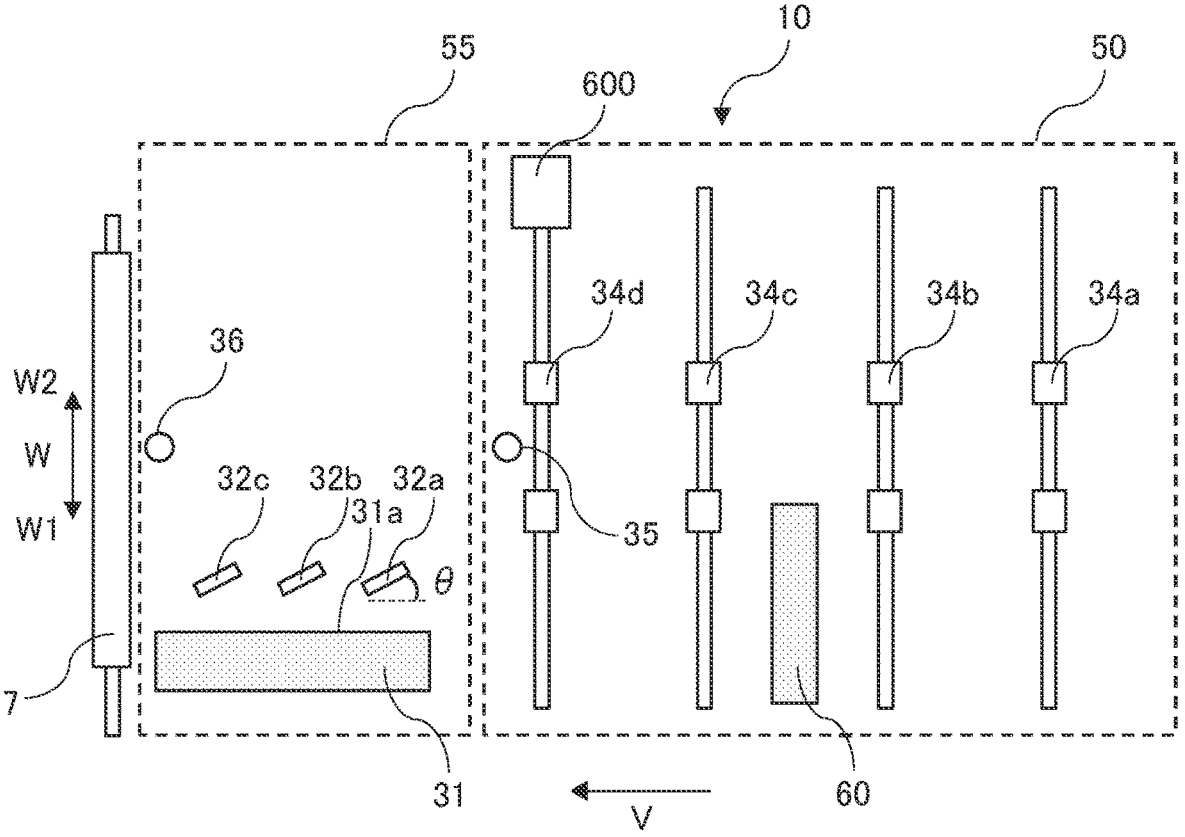
FIG. 2 is a schematic configuration diagram of a sheet conveyance apparatus according to the first embodiment.

FIG. 2 is a top view illustrating the sheet alignment apparatus 10 including the conveyance roller portion 50, the skew feed correcting portion 55, and a registration roller pair 7. As illustrated in FIG. 2, the conveyance roller portion 50 of the sheet alignment apparatus 10 includes four conveyance roller pairs 34*a* to 34*d* respectively conveying the sheet S, and a side edge detection apparatus 60 that detects a position of a side edge of the sheet S. Further, the conveyance roller portion 50 includes a first pre-registration sensor 35 that detects a passage timing of the sheet S.

Further, the skew feed correcting portion 55 of the sheet alignment apparatus 10 includes an abutment member 31 that corrects skewing of the sheet S by abutting against a side edge of the sheet S, and three obliquely conveying roller pairs 32*a* to 32*c* having a conveying force including a component in a conveyance direction V of the sheet S and a component in a width direction W of the sheet S. The skew feed correcting portion 55 further includes a second pre-registration sensor 36 that detects a passage timing of the sheet S.

The abutment member 31 is arranged downstream of a conveyance roller pair 34*d* in the sheet conveyance direction and on one side in the width direction W orthogonal to the conveyance direction V of the sheet. The width direction W includes a first direction W1 from one side toward the other side in the width direction W and a second direction W2 opposite to the first direction W1. The abutment member 31 includes an abutment surface 31*a* that serves as a reference surface capable of abutting against a downstream edge, i.e., side edge, in the first direction W1 of the sheet.

The registration roller pair 7 is configured to be driven to rotate by a drive motor and a transmission gear not shown, and to be in contact with and separated from one another by a contact and separation drive motor and transmission gear not shown, allowing switching between a nipping state and a nipping release state of the sheet S. Further, the conveyance roller pairs 34*a* to 34*d* and the obliquely conveying roller pairs 32*a* to 32*c* are also configured to be driven to rotate and be in contact with and separated from one another, and allowing switching between the nipping state and the nipping release state of the sheet S. The rotation mechanism and the pressure contact/separation mechanism of the conveyance roller pairs 34*a* to 34*d* and the obliquely conveying roller pairs 32*a* to 32*c* will be described in detail below.

The registration roller pair 7 can be shifted in the width direction W illustrated in FIG. 2 by a shift drive motor and a transmission gear not shown. The conveyance roller pairs 34*a* to 34*d* are arranged in parallel in the conveyance direction V. The conveyance roller pairs 34*a* to 34*c* adopt a similar configuration, and the conveyance roller pair 34*d* arranged most downstream in the conveyance direction V includes a shift portion 600 enabling movement thereof in the width direction W. The details of the shift portion 600 will be described below.

The side edge detection apparatus 60 serving as a detection portion is composed of a Contact Image Sensor (CIS), and it is arranged on one side in which the abutment member 31 is arranged from the center in the width direction W at an upstream side in the conveyance direction of the conveyance roller pair 34*c*. In other words, the side edge detection apparatus 60 is arranged on one side in the width direction W orthogonal to the conveyance direction V of the sheet since it is necessary to detect a position of only one side edge of the sheet S to correct the position of the sheet S. The side edge detection apparatus 60 is configured to detect the side edge position of both a sheet having the smallest width and a sheet having the greatest width among the sheet sizes capable of being used in the image forming apparatus 1. In the present embodiment, the side edge detection apparatus 60 is arranged between the conveyance roller pair 34*b* and the conveyance roller pair 34*c* in the conveyance direction V, but the position thereof is not limited thereto. The side edge detection apparatus 60 should merely be arranged upstream of the obliquely conveying roller pair 32*a* in the conveyance direction V, and for example, it can be arranged upstream of the conveyance roller pair 34*a*. Further, it is preferable for the side edge detection apparatus 60 to detect a position of a side edge Sa of the sheet S nipped by the conveyance roller pair 34*d*.

The first pre-registration sensor 35 is arranged approximately at a center in the width direction W downstream of the conveyance roller pair 34*d* and upstream of the obliquely conveying roller pair 32*a* in the conveyance direction V. The first pre-registration sensor 35 is a photosensor including a light emitting portion and a light receiving portion, and by receiving the light emitted from the light emitting portion and reflected on the sheet S, the passage timing of the sheet S is detected.

The conveying roller pairs 32*a* to 32*c* serving as obliquely conveying rotary members are arranged in parallel in the conveyance direction, and adopt similar configurations. The obliquely conveying roller pairs 32*a* to 32*c* are designed to provide a conveyance force including a component in the conveyance direction V of the sheet S and a component in the first direction W1 which is an abutment direction for abutting the sheet against the abutment surface 31*a*, by having the respective rotation shafts inclined by angle θ with respect to the abutment surface 31*a*. The side edge of the sheet S is abutted against the abutment surface 31*a*, by which skewing of the sheet is corrected. In other words, the obliquely conveying roller pairs 32*a* to 32*c* move the sheet S in a direction inclined with respect to the sheet conveyance direction V such that a more downstream side in the sheet conveyance direction V is closer to the abutment surface 31*a* of the abutment member 31 in the width direction W That is, the obliquely conveying roller pairs 32*a* to 32*c* convey the sheet S in the conveyance direction V while moving the sheet S in the first direction W1.

The second pre-registration sensor 36 is arranged at a center in the width direction W at a position downstream of the obliquely conveying roller pair 32*c* and upstream of the registration roller pair 7 in the conveyance direction. The second pre-registration sensor 36 is a photosensor similar to the first pre-registration sensor 35, and detects the passage timing of the sheet S by receiving the light emitted from the light emitting portion and reflected on the sheet S at the light receiving portion.

The registration roller pair 7 includes a drive roller and a driven roller, and in a state where the registration roller pair 7 moves in the width direction W while nipping the sheet S, the toner image formed on the intermediate transfer belt 506 and the width direction W position of the sheet S can be adjusted. The registration roller pair 7 conveys the sheet S after aligning the position of the sheet S in the width direction W.

Figure 3A:
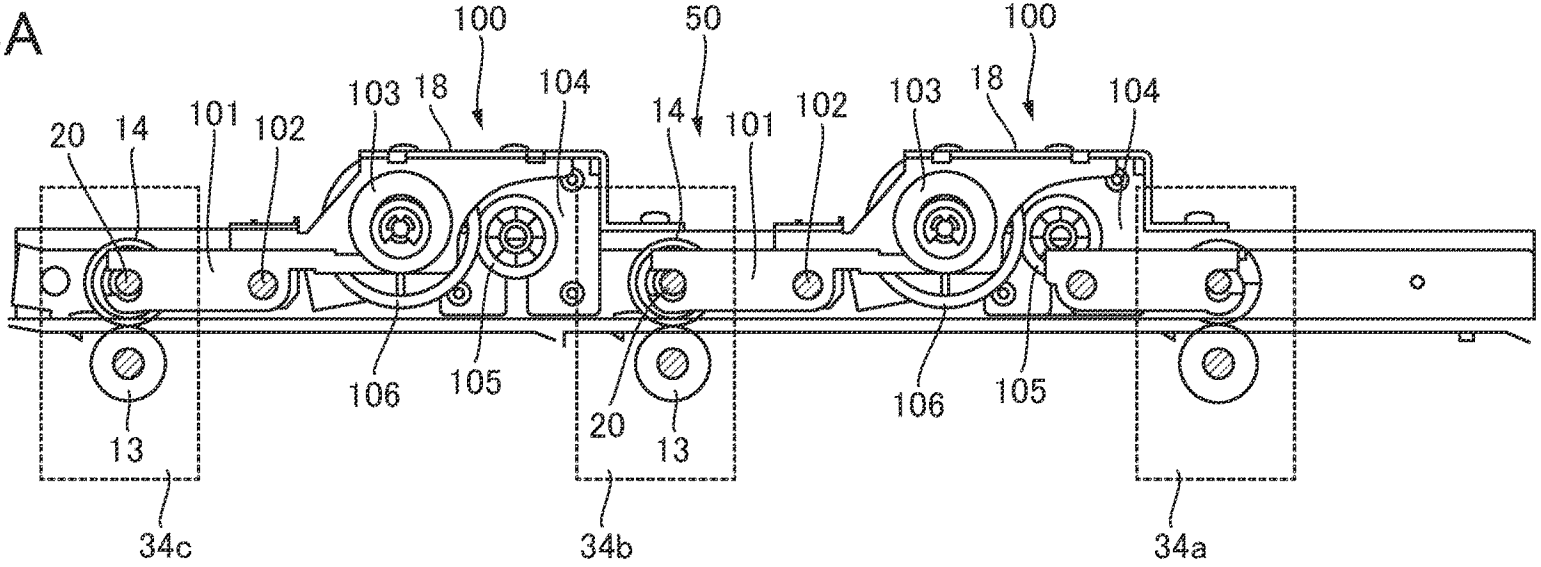
FIG. 3A is a cross-sectional view illustrating a conveyance roller pair of a sheet conveyance portion according to the first embodiment in a nipping state.
Figure 3B:
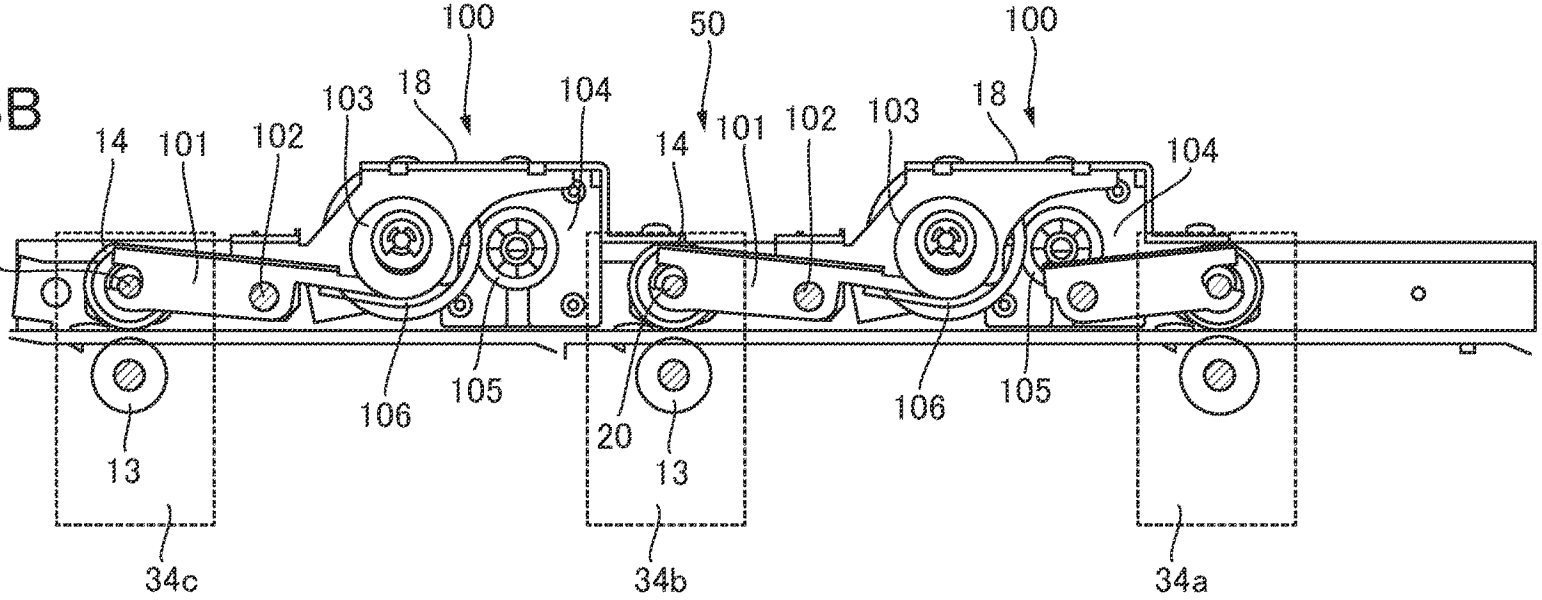
FIG. 3B is a cross-sectional view illustrating the conveyance roller pair in a nipping release state.

Next, a mechanism of releasing the nip formed by each conveyance roller pair by the conveyance roller pairs 34*a* to 34*c* being in a nipping release state will be described. FIG. 3A is a cross-sectional view of the conveyance roller portion 50 in a case where the conveyance roller pairs 34*a* to 34*c* are in a nipping state, and FIG. 3B is a cross-sectional view of the conveyance roller portion 50 in a case where the conveyance roller pairs 34*a* to 34*c* are in a nipping release state. The conveyance roller pair 34*d* arranged most downstream in the conveyance direction among the conveyance roller pairs 34*a* to 34*c* includes the shift portion 600 (refer to FIG. 2) described above, and the details thereof will be described below. Further, as described above, the conveyance roller pairs 34*a* to 34*c* have similar configurations, such that the configuration of the conveyance roller pair 34*a* will be described, and configurations common to the conveyance roller pair 34*a* will not be described.

As illustrated in FIG. 3A, the conveyance roller pair 34*a* is supported via an arm member 101 having a driven shaft 20 supported by a driven roller 14 during the nip pressing state, and it is arranged on a stay member 18 via a swing shaft 102 such that the arm member 101 can swing. In the conveyance roller portion 50, when switching from the nipping state to the nipping release state, an eccentric roller 103 is rotated to press the end portion of the arm member 101 and cause the nip to rotate in the releasing direction about the swing shaft 102.

As illustrated in FIG. 3B, the conveyance roller portion 50 includes the eccentric roller 103, a conveyance and pressing motor 104, and gear trains 105 and 106, as pressing units for pressing the arm member 101. In the conveyance roller portion 50, the arm member 101 is pressed by driving the conveyance and pressing motor 104 serving as a stepping motor and rotating the eccentric roller 103 via the gear trains 105 and 106. The conveyance roller portion 50 separates the driven roller 14 from a drive roller 13 in response to a predetermined releasing timing by the pressing unit, and switches to a nipping release state in which the nip between the drive roller 13 and the driven roller 14 is released.

Figure 4:
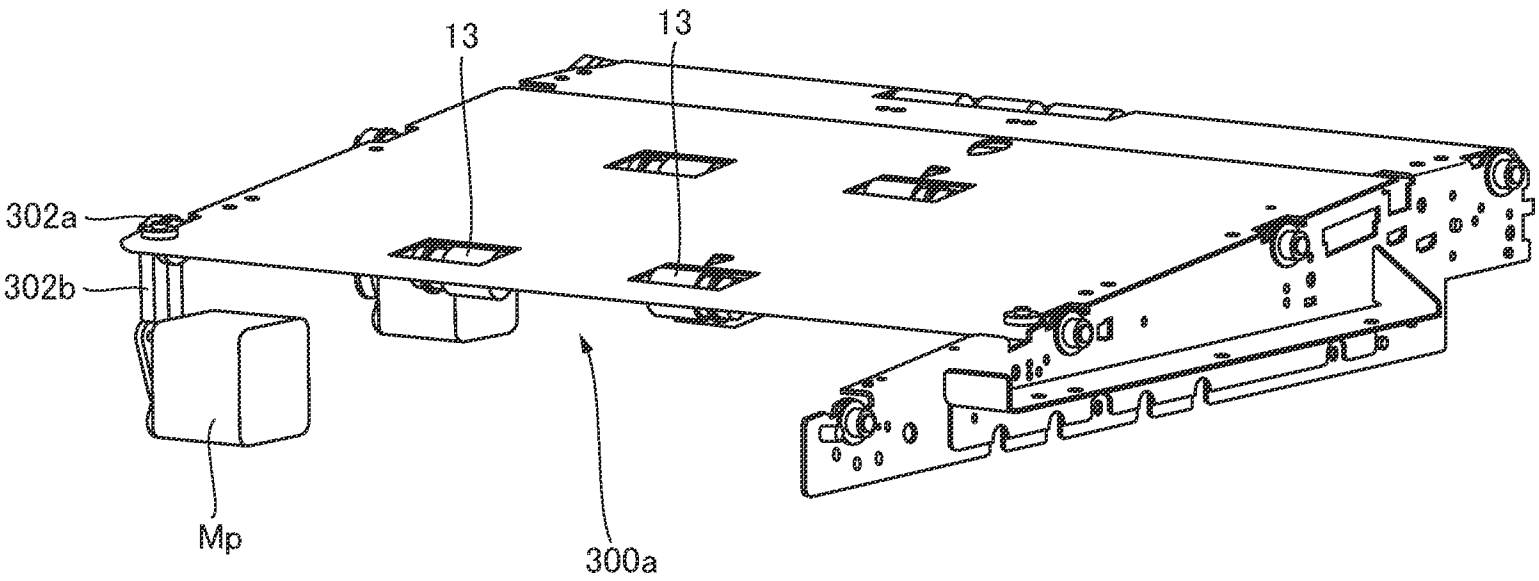
FIG. 4 is a perspective view illustrating a drive configuration of the conveyance roller pair according to the first embodiment.

FIG. 4 is a perspective view of a driving unit 300*a* that drives the drive roller 13 of the conveyance roller pair 34*a* of the conveyance roller portion 50. As illustrated in FIG. 4, the driving unit 300*a* receives transmission of drive from a pre-registration motor Mp via a pulley 302*a* and a belt 302*b* to a shaft configured integrally with the drive roller 13. The pre-registration motor Mp is a stepping motor, and a stopping timing and conveyance speed thereof can be varied to correspond to a timing at which the first pre-registration sensor 35 detects the sheet S.

Figure 5A:
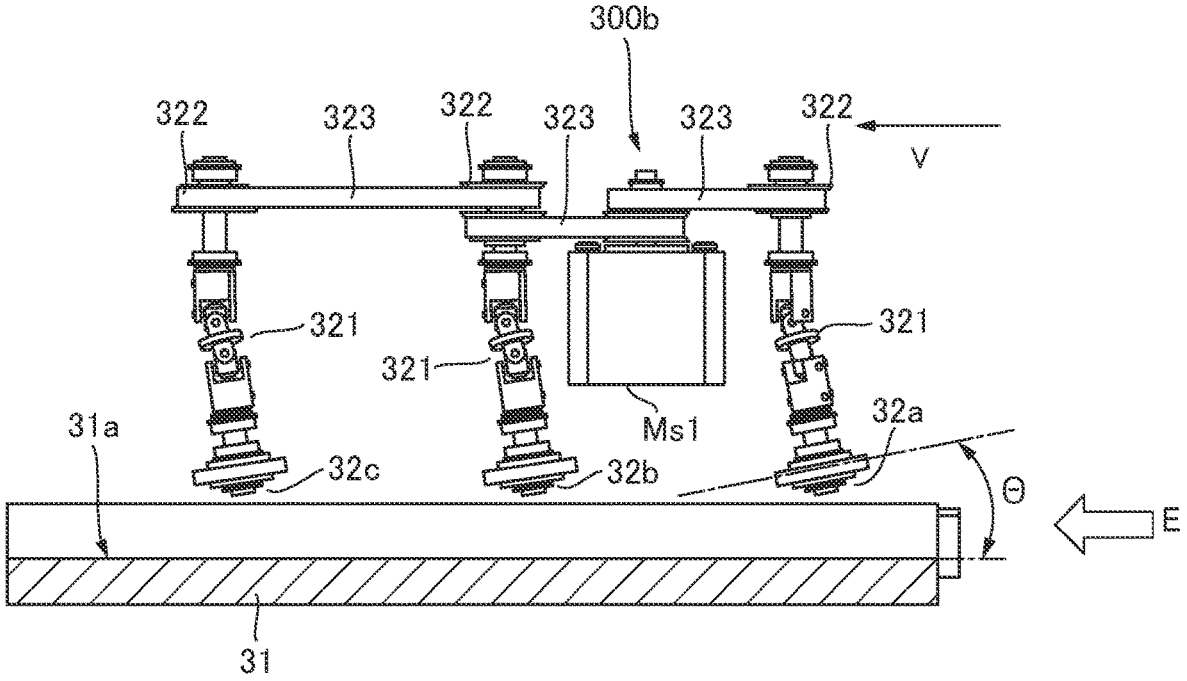
FIG. 5A is a top view illustrating a drive configuration of an obliquely conveying roller pair according to the first embodiment.

FIG. 5A is a top view of a driving unit 300*b* that drives a drive roller 320*a* of the obliquely conveying roller pair 32*a* of the skew feed correcting portion 55. The drive roller 320*a* of the obliquely conveying roller pair 32*a* is arranged at an angle θ with respect to the abutment surface 31*a* of the abutment member 31, and drive is transmitted thereto from an obliquely conveying drive motor Ms1 via a universal joint 321, a pulley 322, and a conveying belt 323. The obliquely conveying drive motor Ms1 is a stepping motor, and a conveyance speed and timing can be varied.

Figure 5B:
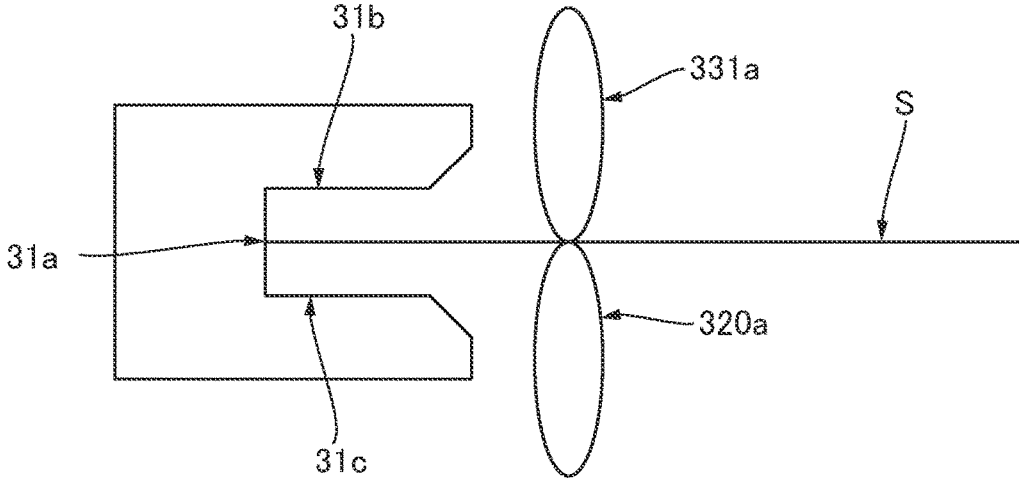
FIG. 5B is a cross-sectional view taken from an arrow E direction of FIG. 5A.

FIG. 5B is a cross-sectional view of the abutment member 31 seen from an arrow E direction of FIG. 5A. The abutment member 31 is formed of the abutment surface 31*a* against which the side edge of the sheet S abuts, and an upper guide 31*b* and a lower guide 31*c* that regulate the upper and lower directions of the sheet S. Further, the abutment member 31 is formed of a die-cast made of aluminum, which has a high precision realized by forming the abutment surface 31*a* through cutting. Further, the abutment member 31 is subjected to Teflon (Registered Trademark) electroless nickel processing. By being formed as described, the abutment member 31 has a high precision abutment surface 31*a* formed thereto, and the slide property of the abutment surface 31*a*, the upper guide 31*b*, and the lower guide 31*c* is improved, such that the alignment of the sheet S can be performed highly accurately.

Figure 6A:
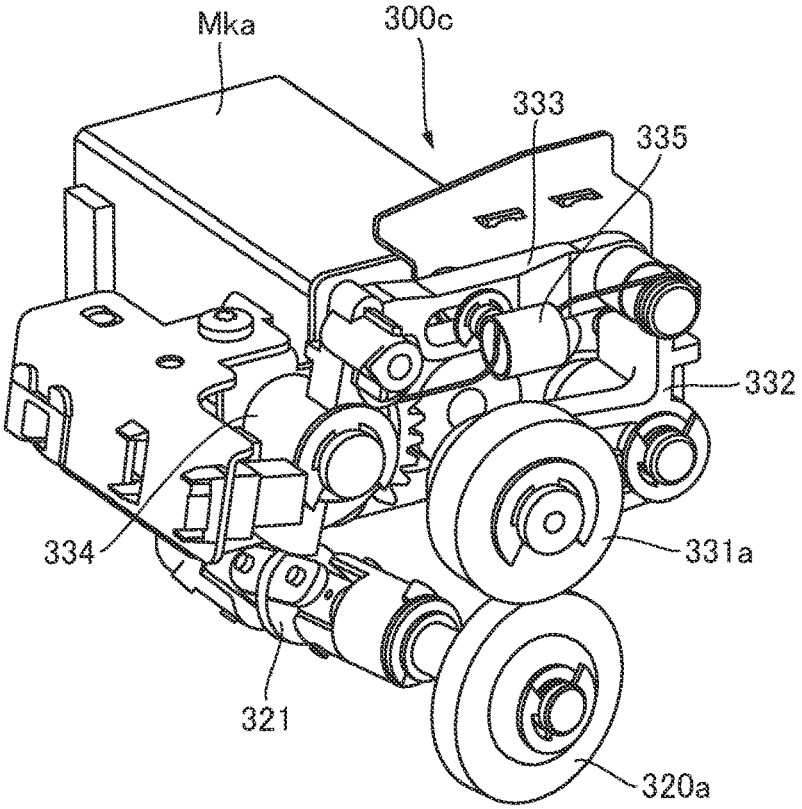
FIG. 6A is a perspective view illustrating a pressure contact/separation mechanism of the obliquely conveying roller pair according to the first embodiment.
Figure 6B:
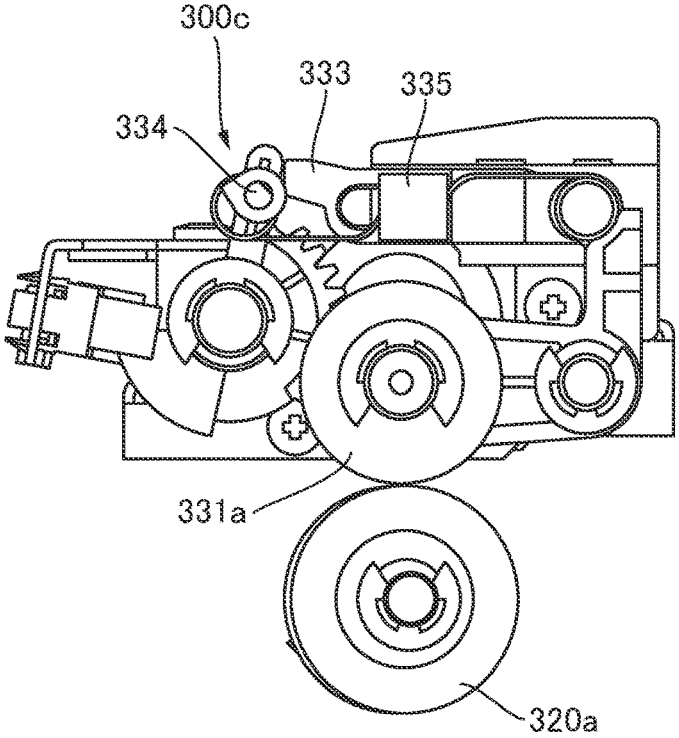
FIG. 6B is a side view illustrating a pressure contact/separation mechanism of the obliquely conveying roller pair.

FIG. 6A is a perspective view of a pressure contact/separation mechanism 300*c* of a driven roller 331*a* opposed to the drive roller 320*a* of the obliquely conveying roller pair 32*a*, and FIG. 6B is a side view of the pressure contact/separation mechanism 300*c* of the driven roller 331*a*. As described above, the obliquely conveying roller pairs 32*a* to 32*c* adopt similar configurations, such that the configuration of the obliquely conveying roller pair 32*a*, serving as an obliquely conveying portion, will be described, and configurations common to the obliquely conveying roller pair 32*a* will not be described.

As illustrated in FIGS. 6A and 6B, a nipping pressure, that is, the nipping pressure of the sheet S, of the driven roller 331*a* is set by a pivot angle of an obliquely conveying pressing roller Mk via a link 332 that supports the driven roller 331*a* rotatably, a pressurizing spring 335, and a pressurizing gear 334.

Figure 7A:
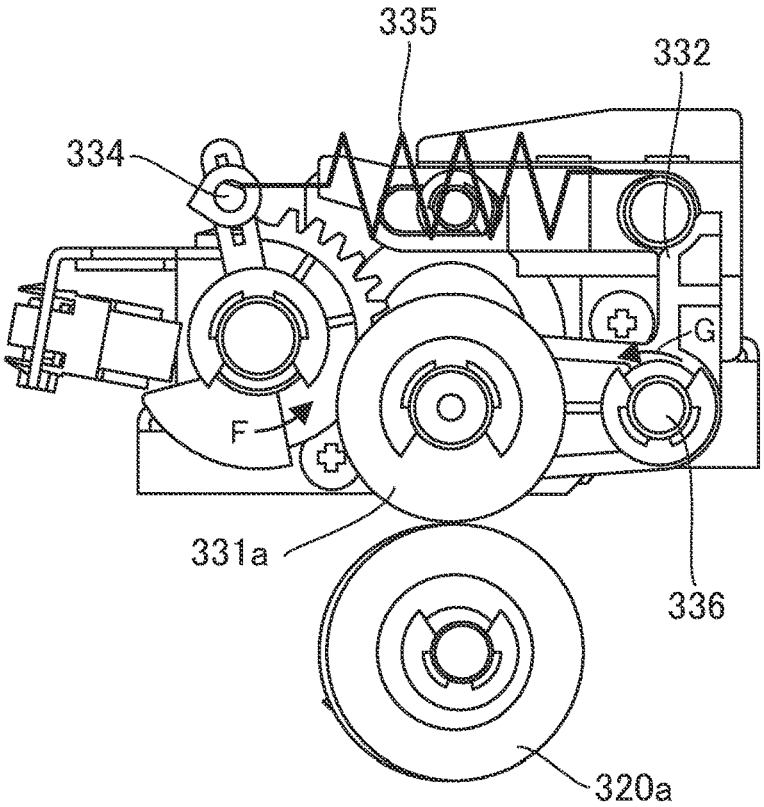
FIG. 7A is a side view illustrating the obliquely conveying roller pair according to the first embodiment in a nipping state.

FIG. 7A illustrates a nipping state, i.e., a nip pressing state, in which the drive roller 320*a* and the driven roller 331*a* are in pressure contact with one another. As illustrated in FIG. 7A, in the obliquely conveying roller pair 32*a*, the pressurizing gear 334 stops in a state pivoted in an arrow F direction in the drawing and pulls the pressurizing spring 335, by which the link 332 pivots in an arrow G direction in the drawing about a shaft 336. Thereby, the driven roller 331*a* pivots in a direction pressing against the drive roller 320*a*, realizing a pressure nip with the drive roller 320*a*.

Figure 7B:
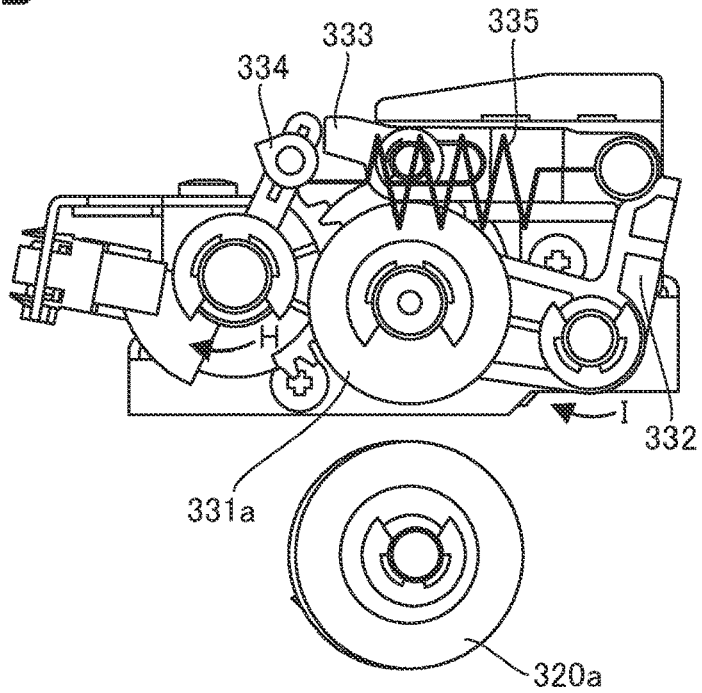
FIG. 7B is a side view illustrating the obliquely conveying roller pair in a nipping release state.

FIG. 7B illustrates a nipping release state, i.e., nip released state, in which the drive roller 320*a* and the driven roller 331*a* are separated. As illustrated in FIG. 7B, the pressurizing gear 334 stops in a state pivoted in an arrow H direction in the drawing, and presses a link 333, by which the link 332 supporting the driven roller 331*a* pivots about the shaft 336 in an arrow I direction in the drawing. Thereby, the driven roller 331*a* pivots in a direction separating from the drive roller 320*a* and the nip is released.

An obliquely conveying pressing roller Mka is a stepping motor, and it is configured to allow an amount of pressure to be varied by setting a step angle. The driven rollers 331*a* to 331*c* of the skew feed correcting portion 55 are respectively independently equipped with obliquely conveying pressing rollers Mka to Mkc. Therefore, the nipping pressures of the driven rollers 331*a* to 331*c* can be set independently in the skew feed correcting portion 55. Further, the skew feed correcting portion 55 enables the driven rollers 331*a* to 331*c* to be separated independently from the drive rollers 320*a* to 320*c*.

Side Edge Detection Apparatus

Figure 8:
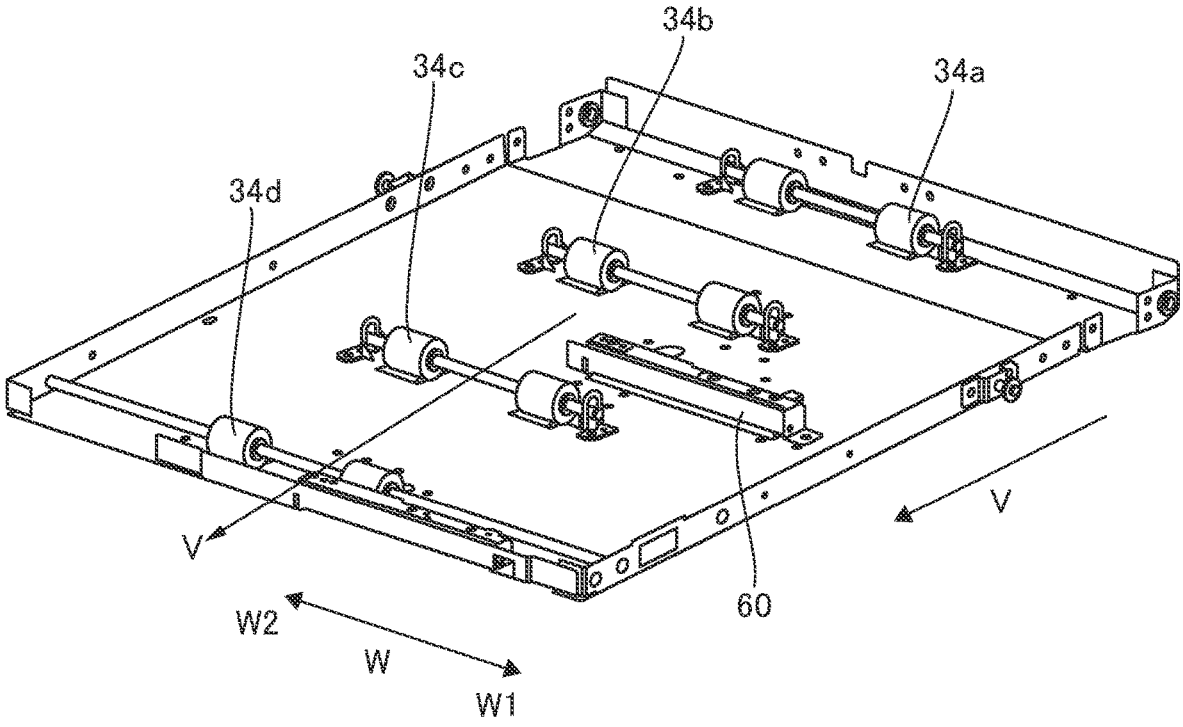
FIG. 8 is a perspective view illustrating a sheet conveyance portion according to the first embodiment.

Next, the side edge detection apparatus 60 will be described with reference to FIG. 8. FIG. 8 is a perspective view of the conveyance roller portion 50 including the side edge detection apparatus 60. As illustrated in FIG. 8, the side edge detection apparatus 60 is arranged at a position biased from the center in the width direction W of the sheet S toward the same direction as the abutment member 31 with respect to the conveyance direction V serving as the sheet conveyance direction. The side edge detection apparatus 60 detects a side edge of the sheet S on a side being abutted against the abutment member 31, that is, a side edge position on one side of the sheet in the width direction W. Thereby, the side edge detection apparatus 60 can stably measure the relative distance between the position of the sheet S prior to skew correction and the position of the abutment surface 31*a* of the abutment member 31 regardless of any cutting deviation of the sheet S in the width direction W.

Details of Conveyance Roller Pair 34*d*

Next, FIGS. 9 to 11B are referred to in describing the conveyance roller pair 34*d* arranged most downstream in the conveyance direction of the conveyance roller portion 50, and the shift portion 600 for shifting the conveyance roller pair 34*d*. The conveyance roller pair 34*d* serving as a first rotary member pair includes a driving unit 800 that drives a drive roller 402 of the conveyance roller pair 34*d*, and the shift portion 600 that allows the conveyance roller pair 34*d* to move in the width direction W. Further, the conveyance roller pair 34*d* includes a pressure release mechanism 700 that separates a driven roller 401 from the drive roller 402.

Figure 9:
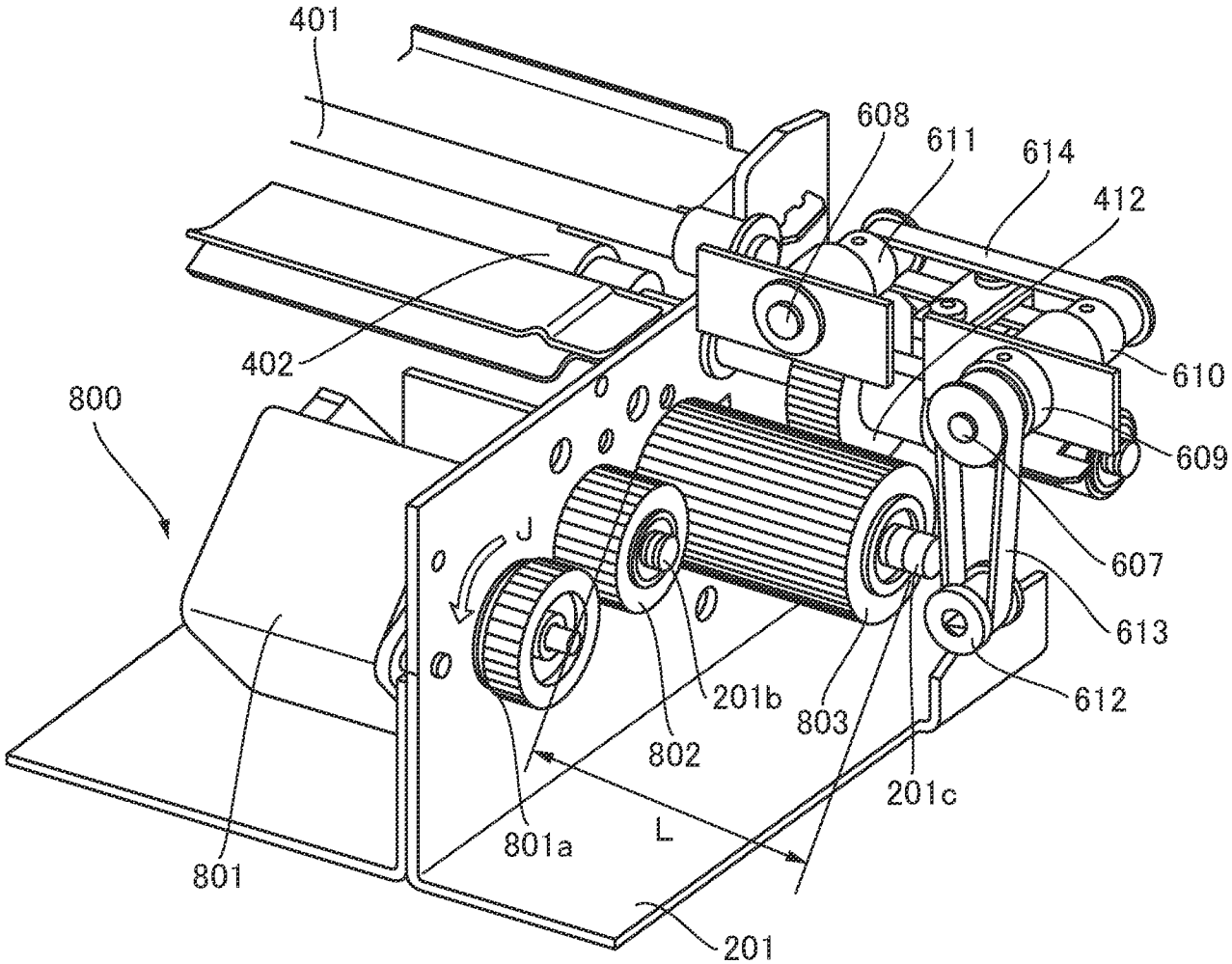
FIG. 9 is a perspective view illustrating a driving unit of the conveyance roller pair according to the first embodiment.

FIG. 9 is a perspective view of the driving unit 800. As illustrated in FIG. 9, in the driving unit 800, a driving force of a motor 801 fixed to a frame 201 is transmitted via driving gears 801*a*, 802, and 803 to a conveyance roller gear 412. The driving gear 803 has a tooth surface having a length L longer than a reciprocating width of the conveyance roller gear 412 such that meshing of the driving gear 803 is not disengaged even when the conveyance roller gear 412 is moved in reciprocating motion by the shift portion 600.

The motor 801 according to the first embodiment is composed of a stepping motor. The driving gear 801*a* is arranged on the motor 801 and rotates in an arrow J direction in the drawing. The driving gear 802 is arranged rotatably via a bearing to a fixed shaft 201*b* of the frame 201. The driving gear 803 is arranged rotatably via a bearing to a fixed shaft 201*c* of the frame 201.

Figure 10:
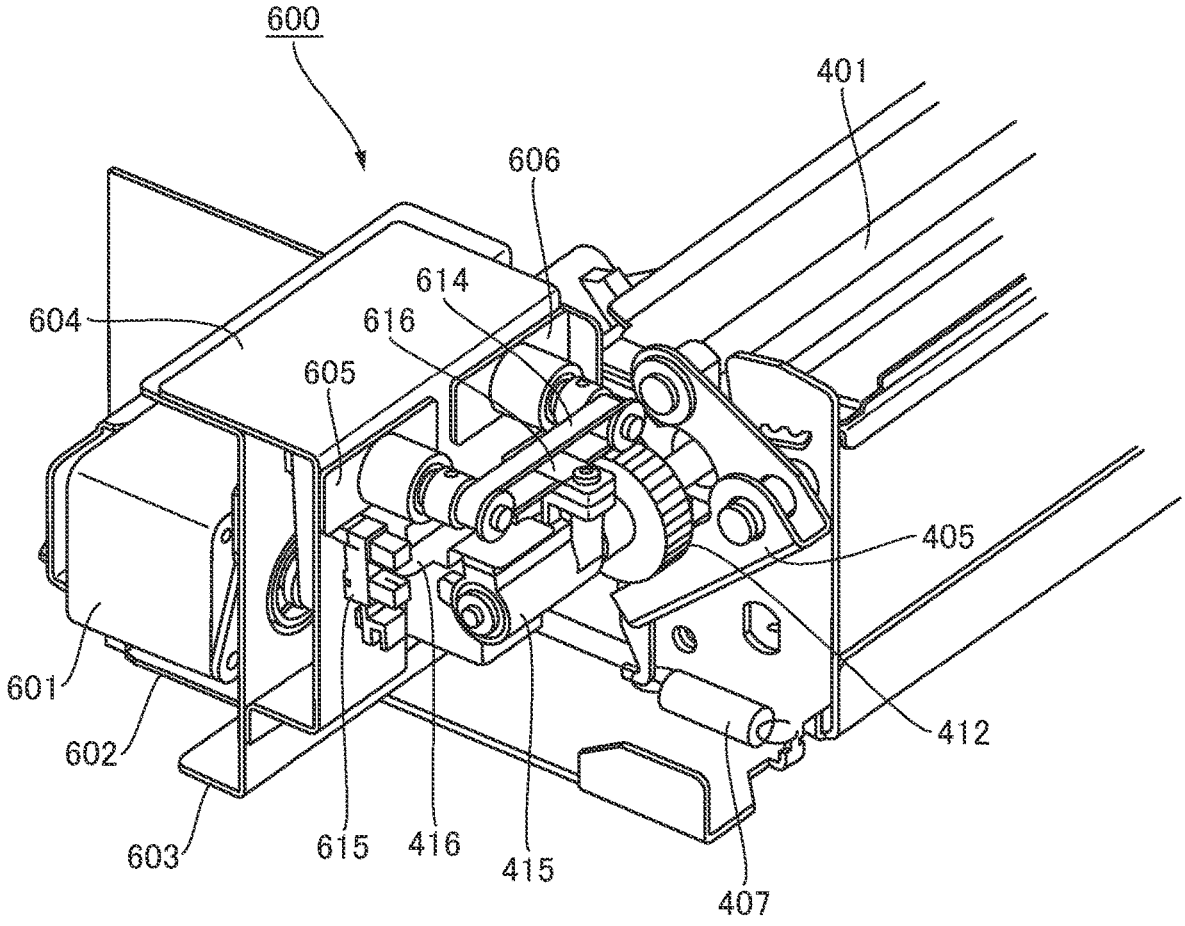
FIG. 10 is a perspective view illustrating a shift portion of the conveyance roller pair according to the first embodiment.

FIG. 10 is a perspective view of the shift portion 600. As illustrated in FIG. 10, the shift portion 600 includes a slide motor 601 that is screwed onto a motor support plate 603 in a state fixed to a motor base 602. A pulley support plate 604 is screwed onto an upper part of the motor support plate 603 via the slide motor 601. Pulley bases 605 and 606 are fixed to the pulley support plate 604. A pulley shaft 607 is rotatably fixed to the pulley base 605, and a pulley shaft 608 is rotatably fixed to the pulley base 606. Pulleys 609 and 610 are fixed to the pulley shaft 607, and a pulley 611 is fixed to the pulley shaft 608. A pulley 612 is fixed to an end of an output shaft of the slide motor 601. A timing belt 613 (refer to FIG. 9) is hung around the pulley 609 and the pulley 612, and a timing belt 614 is hung around the pulley 610 and the pulley 611.

A holder 415 is supported rotatably by a bearing on an end portion of the drive roller 402 on the side of the conveyance roller gear 412. A sensor flag 416 for detecting a home position in the width direction W of the driven roller 401 and the drive roller 402 of the conveyance roller pair 34*d* is attached to the holder 415. When the driven roller 401 and the drive roller 402 of the conveyance roller pair 34*d* are at the home position, the sensor flag 416 is detected by a sensor 615 disposed on the pulley support plate 604. Further, the holder 415 is fixed to the timing belt 614 by a stopper 616 and a screw not shown.

According to this configuration, the timing belt 614 rotates by the drive of the slide motor 601, and the drive roller 402 of the conveyance roller pair 34*d* moves in reciprocating motion in the width direction W orthogonal to the sheet conveyance direction V along with the rotation of the timing belt 614. Further, the driven roller 401 of the conveyance roller pair 34*d* is engaged to the drive roller 402 by an engagement member not shown, and moves in reciprocating motion in the width direction W together with the drive roller 402.

In the first embodiment, in a case where the side edge of the sheet S is detectable by the side edge detection apparatus 60, the slide motor 601 is driven to move the conveyance roller pair 34*d* in the width direction W based on the detection result of the side edge position of the sheet S in the width direction W being detected. Further, in a case where the sheet S is a transparent sheet and the side edge thereof is undetectable by the side edge detection apparatus 60, the slide motor 601 is driven to move the conveyance roller pair 34*d* in the width direction W based on a predetermined shift amount. In this manner, the shift portion 600 serving as a moving unit and a first moving unit is configured to move the conveyance roller pair 34*d*, nipping the sheet, in the width direction W. Details of the control regarding the movement of the shift portion 600 will be described below.

Figure 11A:
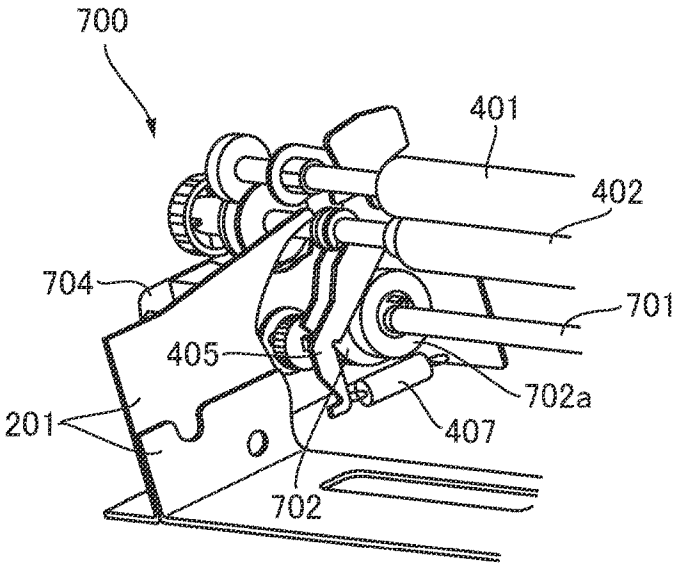
FIG. 11A is a perspective view of a pressure release mechanism of the conveyance roller pair according to the first embodiment.
Figure 11B:
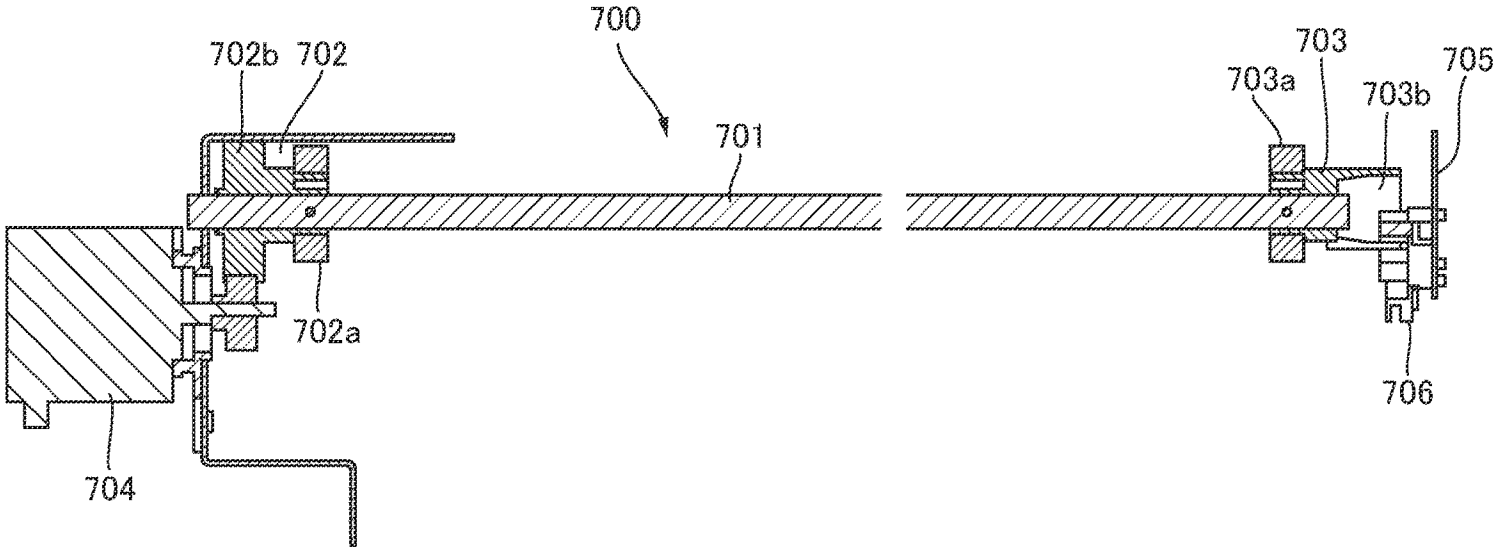
FIG. 11B is a cross-sectional view of the pressure release mechanism of the conveyance roller pair according to the first embodiment.

The pressure release mechanism 700 that causes the driven roller 401 and the drive roller 402 of the conveyance roller pair 34*d* to be in contact with and separate from one another includes a pressure releasing shaft 701 positioned on the frame 201, as illustrated in FIG. 11A. Further, the pressure release mechanism 700 is configured to include cams 702 and 703 (refer to FIG. 11B) fixed to the pressure releasing shaft 701. As illustrated in FIG. 11B, the cams 702 and 703 include deep groove ball bearings 702*a* and 703*a* which are respectively press-fit thereto at a position eccentric from a respective center of rotation thereof. Further, as illustrated in FIG. 11A, a gear 702*b* is formed on the cam 702, and drive of a pressure releasing motor 704 is transmitted via the cam 702 to rotate a pressure releasing shaft 70.

Further, the deep groove ball bearing 702*a* is arranged at a position capable of being in contact with a pressure arm 405, and when the pressure releasing shaft 701 is rotated once, the deep groove ball bearing 702*a* causes the pressure arm 405 to swing against the urging force of a spring 407. By swinging the pressure arm 405 in this manner, the driven roller 401 and the drive roller 402 can be caused to come in contact with and separate from each other once. Further, a pressure arm not shown is also provided on a side of the pressure releasing shaft 701 in the axial direction where the deep groove ball bearing 703*a* is provided. Further, the cam 703 has a sensor flag 703*b* formed thereto (refer to FIG. 11B). A phase of the pressure releasing shaft 701 is determined by the sensor flag 703*b* being detected by a sensor 706 fixed to a sensor support plate 705 fixed to the frame 201, and the rotation of the pressure releasing motor 704 is controlled according to the phase of the pressure releasing shaft 701. Further, the phase of the cams 702 and 703 is determined such that the sensor flag 703*b* blocks the sensor 706 when the driven roller 401 and the drive roller 402 of the conveyance roller pair 34*d* are in contact with each other.

Control Configuration of Sheet Alignment Apparatus

Figure 12:
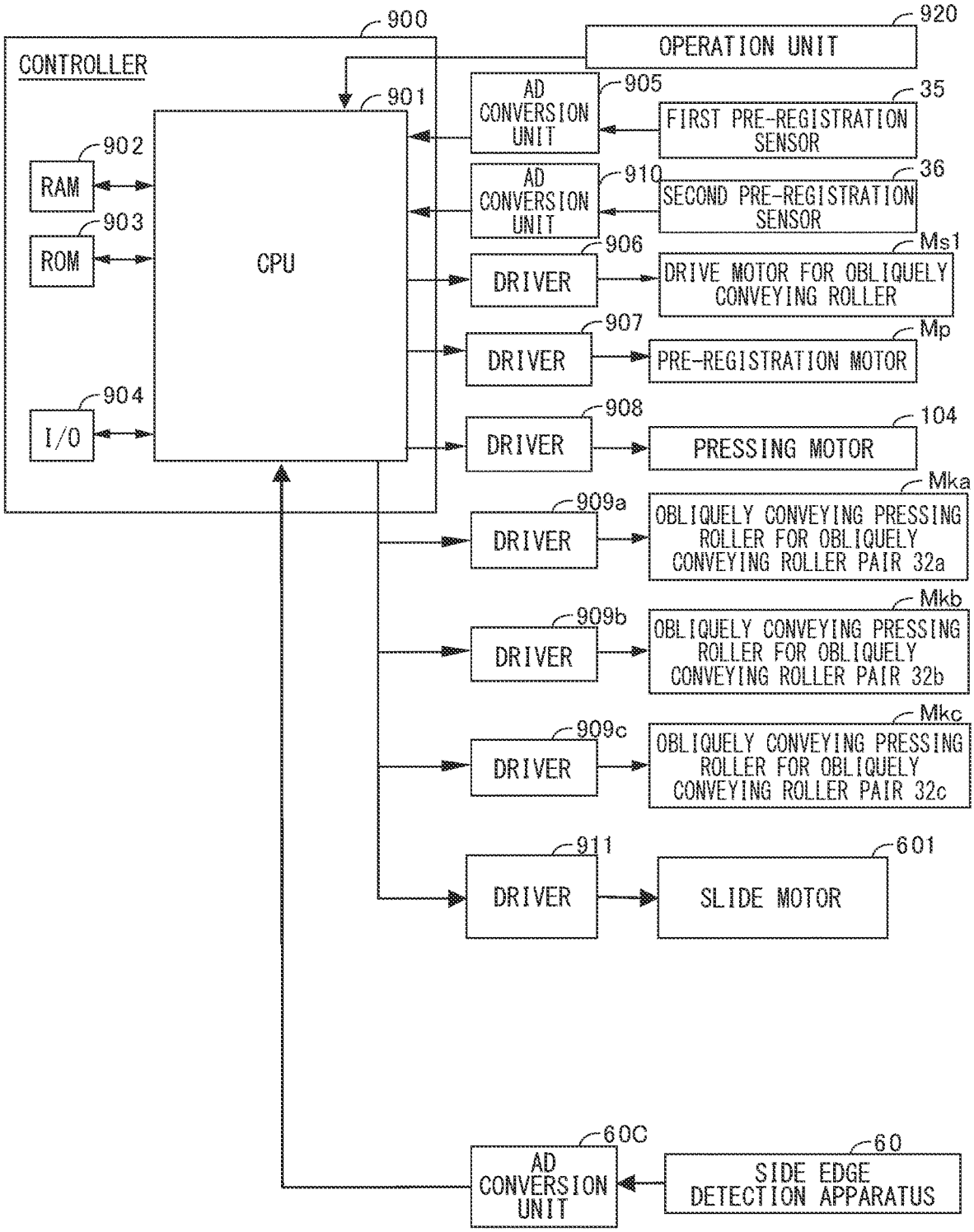
FIG. 12 is a functional block diagram illustrating a control configuration of the sheet conveyance apparatus according to the first embodiment.

Next, a control configuration of the sheet alignment apparatus 10 will be described with reference to FIG. 12. As illustrated in FIG. 12, the operation of the sheet alignment apparatus 10 is controlled by a controller 900 provided on the image forming apparatus 1. The controller 900 serving as one example of a control unit according to the first embodiment includes a CPU 901 serving as a computing unit, a RAM 902 and a ROM 903 serving as storage, and an interface (I/O) 904 to an external apparatus or to a network.

The CPU 901 performs control based on an information entered through an operation unit 920 serving as a user interface or detection signals sent from the first pre-registration sensor 35 and the second pre-registration sensor 36 mentioned above. The detection signals from the first pre-registration sensor 35 and the second pre-registration sensor 36 are entered to the CPU 901 through AD conversion units 905 and 910, respectively. Further, detection signals from the side edge detection apparatus 60 are entered to the CPU 901 via an AD conversion unit 60C. The CPU 901 loads and executes programs stored in the ROM 903. The CPU 901 performs drive control of a group of motors (Ms1, Mp, 104, Mka to Mkc, and 601), which are actuators of the sheet alignment apparatus 10, via drivers 906, 907, 908, and 909*a* to 909*c*. That is, the CPU 901 serving as the control unit is configured to control the shift portion 600 by performing drive control of the slide motor 601.

Registration Correction by Sheet Alignment Apparatus

Next, a registration correction that is executed prior to skew correction in the sheet alignment apparatus 10 will be described.

Figure 13A:
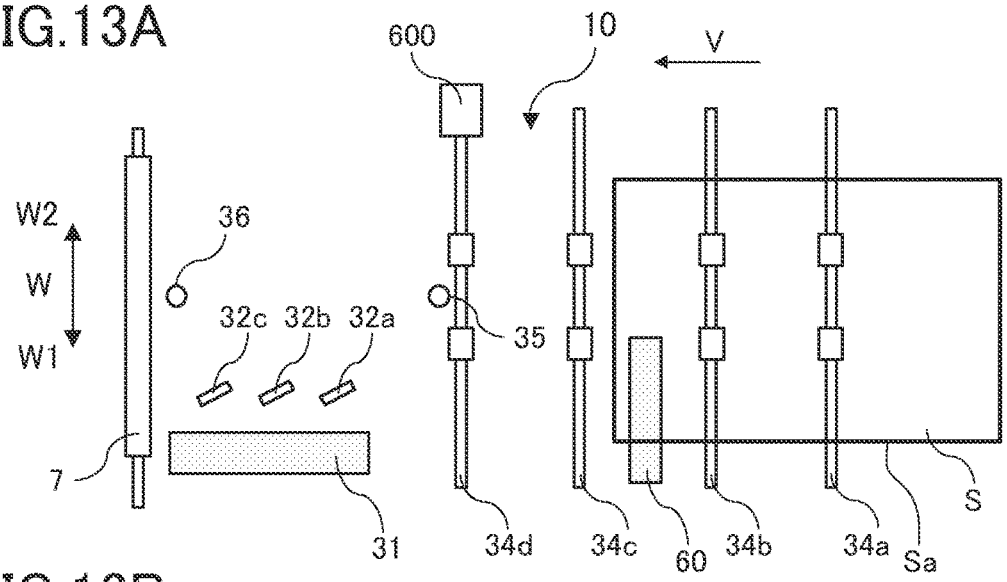
FIG. 13A is a top view illustrating a state of conveyance of a sheet having a side edge detectable by a side edge detection apparatus of a sheet alignment apparatus according to the first embodiment.
Figure 13B:
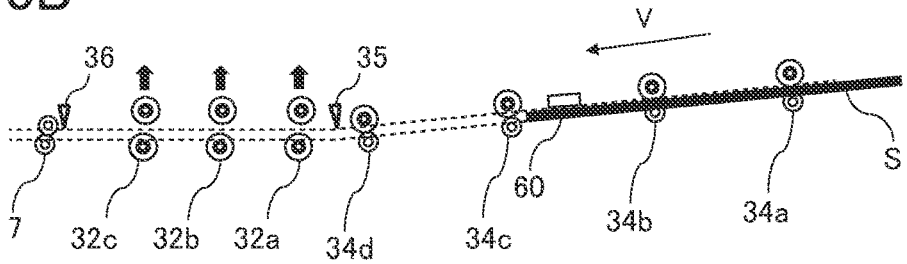
FIG. 13B is a cross-sectional view of the state illustrated in FIG. 13A.

At first, a registration correction of a sheet having a side edge that is detectable by the side edge detection apparatus 60 will be described. FIG. 13A is a top view illustrating a state in which the sheet S having a side edge Sa detectable by the side edge detection apparatus 60 has been conveyed to the sheet alignment apparatus 10, and FIG. 13B is a cross-sectional view of the sheet alignment apparatus 10 in the state illustrated in FIG. 13A. As illustrated in FIGS. 13A and 13B, in the sheet alignment apparatus 10, when the sheet S being conveyed in the conveyance direction V enters the side edge detection apparatus 60, the position of the side edge Sa, i.e., side edge position, of the sheet S is detected by the side edge detection apparatus 60. The side edge Sa is a downstream edge of the sheet S in the first direction W1. Based on the detection result of the side edge detection apparatus 60, the CPU 901 (refer to FIG. 12) calculates an amount of deviation of the detected side edge position from a side edge position in which a center in the width direction W of a conveyance path of the sheet S and a center of the sheet S in the width direction W correspond.

Figure 13C:
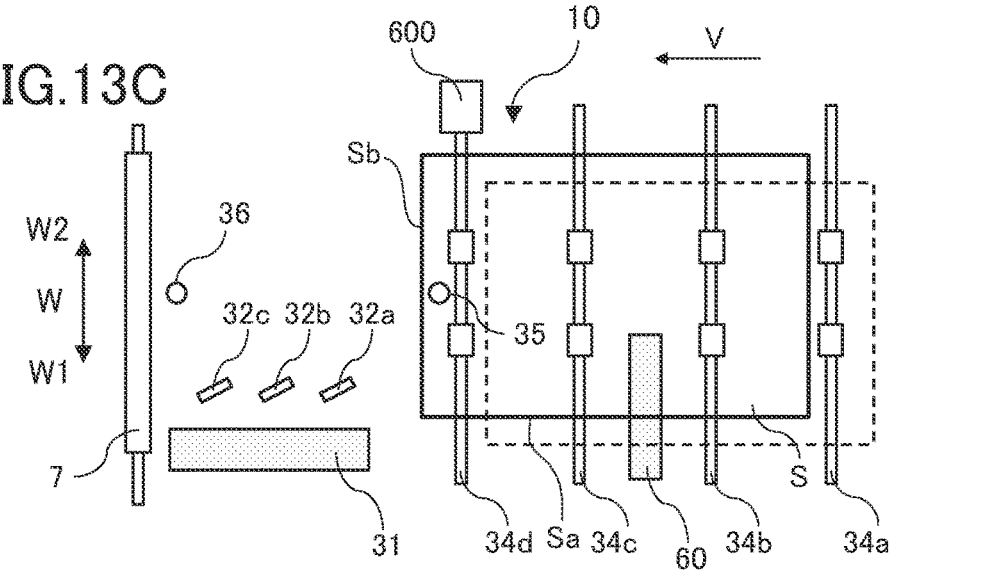
FIG. 13C is a top view illustrating a state of conveyance of the sheet from the state illustrated in FIGS. 13A and 13B to a sheet conveyable position by the conveyance roller pair.
Figure 13D:
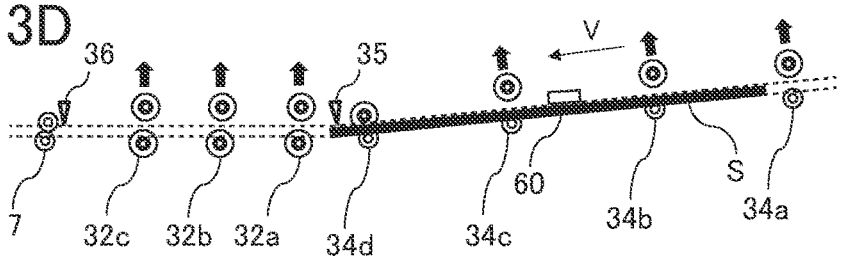
FIG. 13D is a cross-sectional view of the state illustrated in FIG. 13C.

FIG. 13C is a top view illustrating a state in which the sheet S is conveyed from the state illustrated in FIGS. 13A and 13B to a conveyable position by the conveyance roller pair 34*d*, and FIG. 13D is a cross-sectional view of the sheet alignment apparatus 10 in the state illustrated in FIG. 13C. As illustrated in FIGS. 13C and 13D, in the sheet alignment apparatus 10, after the sheet S has reached the conveyance roller pair 34*d*, the conveyance roller pairs 34*a* to 34*c* are separated. Based on the amount of deviation being calculated as above, the CPU 901 causes the shift portion 600 to shift the conveyance roller pair 34*d* such that the distance between the abutment surface 31*a* of the abutment member 31 and the side edge Sa of the sheet S nipped by the conveyance roller pair 34*d* is set to a first distance, such as 4 mm.

As described, in a case where the type of the sheet S is a type of sheet detectable by the side edge detection apparatus 60, the sheet alignment apparatus 10 performs a registration correction in which the sheet S is shifted in the width direction W while being conveyed in the conveyance direction V by the conveyance roller pair 34*d*. This type of sheet detectable by the side edge detection apparatus 60 composed of a CIS constitutes a first type. Further, the conveyance roller pair 34*c* that is arranged adjacent to the conveyance roller pair 34*d* and arranged upstream of the conveyance roller pair 34*d* in the sheet conveyance direction constitutes a second rotary member pair.

Next, a registration correction of a sheet having a side edge Sa that is undetectable by the side edge detection apparatus 60 will be described. As described above, the side edge detection apparatus 60 is composed of a CIS, and it is configured such that the side edge Sa of the sheet is undetectable in a case where the type of sheet is a transparent sheet, such as an OHP film.

Figure 14A:
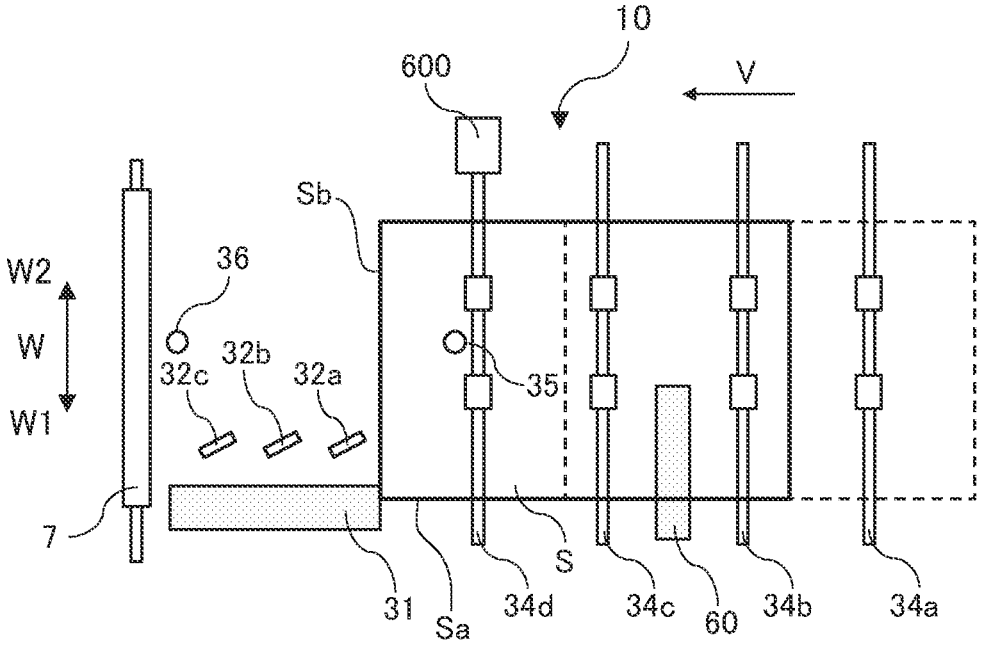
FIG. 14A is a top view illustrating an example of a state in which a sheet having a side edge undetectable by the side edge detection apparatus of the sheet alignment apparatus is conveyed to an abutment member without being subjected to registration correction.
Figure 14B:
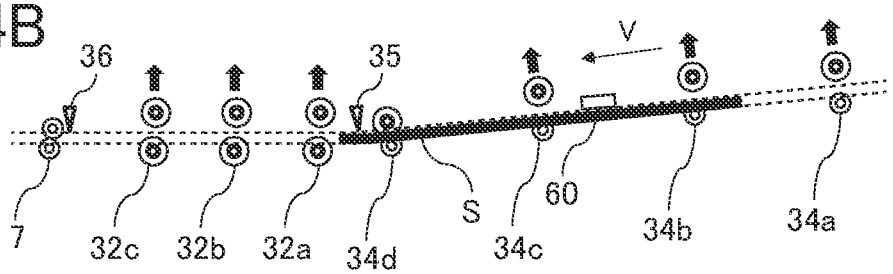
FIG. 14B is a cross-sectional view of the state illustrated in FIG. 14A.

Therefore, if the sheet alignment apparatus 10 is configured to perform a registration correction using the detection result of the side edge detection apparatus 60 even if the sheet S is a transparent sheet, the deviation quantity cannot be calculated even when the sheet S has reached the conveyance roller pair 34*d*, and the shift cannot be performed. As a result, as illustrated in FIG. 14A, in a case where the sheet S is conveyed in a biased state biased toward the abutment member 31 from the center in the width direction W of the conveyance path, a leading edge Sb of the sheet S may collide against the abutment member 31.

Figure 15A:
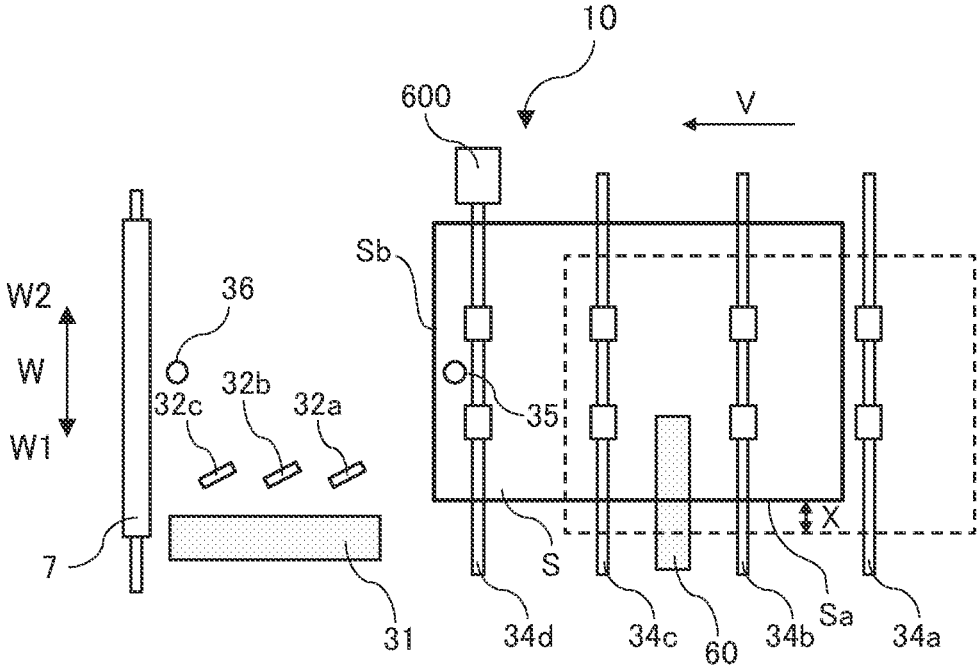
FIG. 15A is a top view illustrating a state in which the sheet having a side edge undetectable by the side edge detection apparatus of the sheet alignment apparatus according to the first embodiment is subjected to registration correction.
Figure 15B:
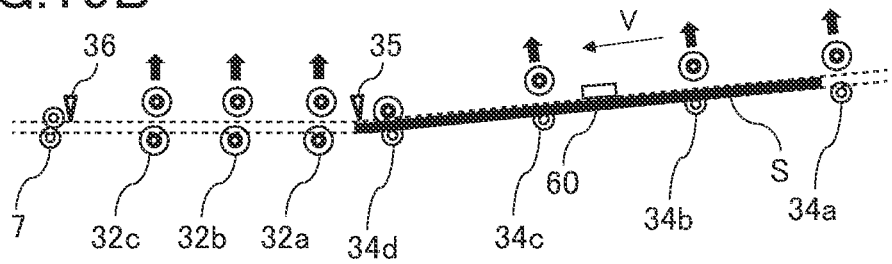
FIG. 15B is a cross-sectional view of the state illustrated in FIG. 15A.

Therefore, according to the first embodiment, if information indicating that the sheet is a transparent sheet is entered from the operation unit 920 (refer to FIG. 12), the sheet alignment apparatus 10 is configured to shift the sheet S to the second direction W2 for a predetermined shift amount X (for example, 6 mm), as illustrated in FIG. 15A.

The sheet alignment apparatus 10 performs a registration correction in which the sheet S is shifted for a predetermined shift amount X in the second direction W2, regardless of the detection result of the side edge detection apparatus 60, after the first pre-registration sensor 35 has detected the sheet S and the conveyance roller pairs 34*a* to 34*c* have been separated. That is, in a case where the conveyance roller pair 34*d*, nipping the sheet, moves in the width direction W, the nip of the conveyance roller pairs 34*a* to 34*c* is released.

As described, in the sheet alignment apparatus 10, if the type of the sheet S is the type of sheet having a transparency that is undetectable by the side edge detection apparatus 60, a registration control is performed in which the sheet S is shifted in the second direction W2 while being conveyed in the conveyance direction V by the conveyance roller pair 34*d*. This type of sheet having a transparency that is undetectable by the side edge detection apparatus 60 composed of the CIS constitutes a second type.

According to the sheet alignment apparatus 10, if the type of the sheet S is a type that is detectable by the side edge detection apparatus 60, the sheet S is shifted in the width direction W by registration correction such that the distance from the abutment surface 31*a* to the side edge Sa of the sheet S is set to a first distance. Further according to the sheet alignment apparatus 10, if the type of sheet S is a type that is undetectable by the side edge detection apparatus 60, the sheet is moved for a shift amount X serving as a second distance to the second direction W2 by registration correction. In the sheet alignment apparatus 10 according to the first embodiment, the second distance is set longer than the first distance.

According to this configuration, the sheet alignment apparatus 10 can reliably prevent the leading edge Sb of the sheet S in the conveyance direction V from colliding against the abutment member 31 by performing registration correction in a case where the type of the sheet S is a type that is undetectable by the side edge detection apparatus 60.

The second distance is set based on a smallest size of the sheet in the width direction W that is conveyable in the image forming apparatus 1, and a configuration from the feeding of the sheet to reaching the registration correction. Actually, the second distance is set to a range of distance such that even if the sheet is shifted for a second distance in the most dispersed state within the range conveyable by the image forming apparatus 1, the sheet S is still nipped by the nip between the obliquely conveying roller pairs 32*a* to 32*c*.

Therefore, in the sheet alignment apparatus 10, even if registration correction is performed in which the sheet S is shifted for a second distance in the direction moving away from the abutment member 31 in a case where the type of the sheet S is a type undetectable by the side edge detection apparatus 60, skew correction by the obliquely conveying roller pairs 32*a* to 32*c* can be performed.

Further, according to the sheet alignment apparatus 10, by performing registration correction by the conveyance roller pair 34*d* after the conveyance roller pairs 34*a* to 34*c* have been separated, registration correction can be performed without interference from the conveyance roller pairs 34*a* to 34*c*.

Skew Correction by Sheet Alignment Apparatus

Figure 16A:
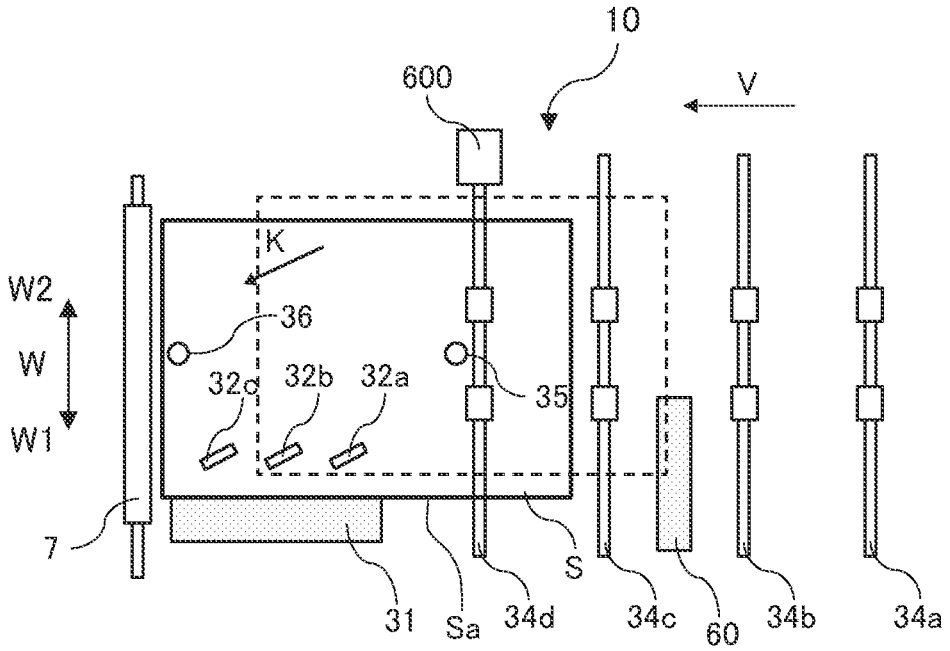
FIG. 16A is a top view illustrating a state in which skew correction has been performed in the sheet alignment apparatus according to the first embodiment.
Figure 16B:
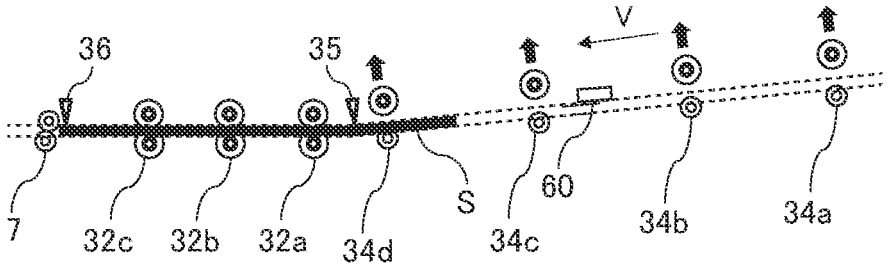
FIG. 16B is a cross-sectional view of the state illustrated in FIG. 16A.

FIG. 16A is a top view illustrating the sheet alignment apparatus 10 in a case where skew correction of the sheet S having been subjected to registration correction is performed, and FIG. 16B is a cross-sectional view of the sheet alignment apparatus 10 in the state illustrated in FIG. 16A. As illustrated in FIGS. 16A and 16B, in the sheet alignment apparatus 10, the sheet S is conveyed in an arrow K direction in the drawing by the obliquely conveying roller pairs 32*a* to 32*c*, and the side edge Sa of the sheet S is abutted against the abutment surface 31*a* of the abutment member 31. In the sheet alignment apparatus 10, when skew correction is performed, the obliquely conveying roller pairs 32*a* to 32*c* are pressed against each other and the conveyance roller pairs 34*a* to 34*d* are separated.

Therefore, according to the sheet alignment apparatus 10, skew correction can be performed without interference from the conveyance roller pairs 34*a* to 34*d* by performing skew correction using the obliquely conveying roller pairs 32*a* to 32*c* after the conveyance roller pairs 34*a* to 34*d* have been separated. That is, when the sheet S is conveyed by the obliquely conveying roller pairs 32*a* to 32*c*, the nip of the conveyance roller pairs 34*a* to 34*d* is released.

Shift by Registration Roller Pair

Figure 17A:
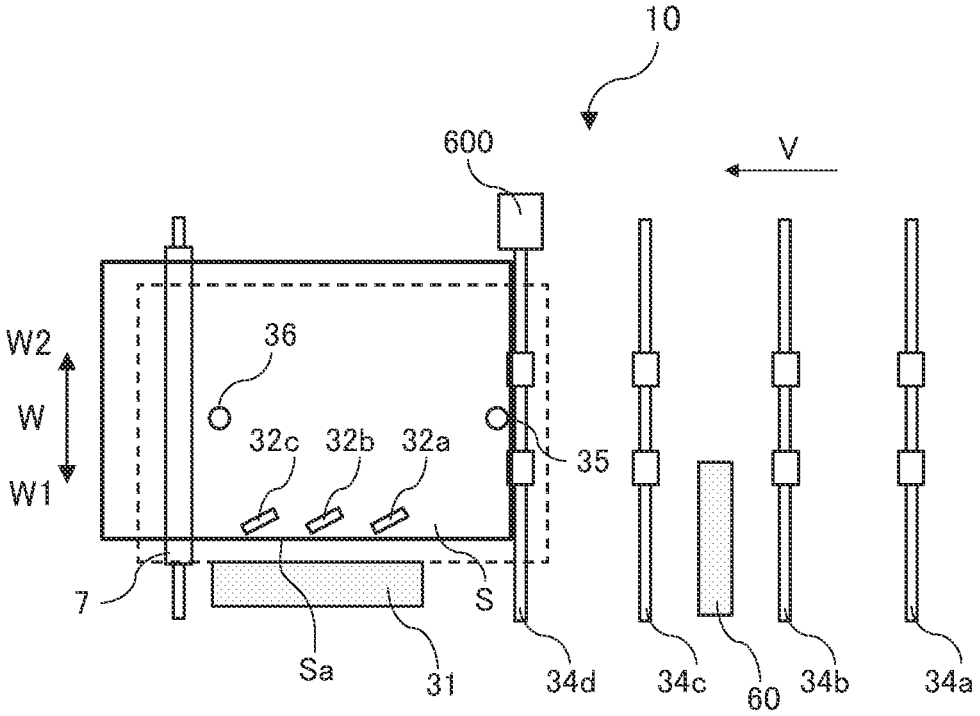
FIG. 17A is a top view illustrating a state in which correction by a registration roller pair has been performed in the sheet alignment apparatus according to the first embodiment.
Figure 17B:
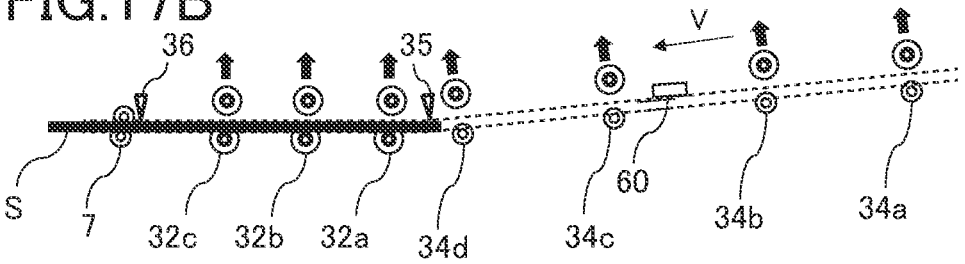
FIG. 17B is a cross-sectional view of the state illustrated in FIG. 17A.

FIG. 17A is a top view illustrating the sheet alignment apparatus 10 in a case where the sheet S having been subjected to skew correction is conveyed to a secondary transfer portion, and FIG. 17B is a cross-sectional view of the sheet alignment apparatus 10 in the state illustrated in FIG. 17A. As illustrated in FIGS. 17A and 17B, in the sheet alignment apparatus 10, the sheet S is shifted in the second direction W2 by the registration roller pair 7 such that the position of the sheet S in the width direction W corresponds to the position of the image in the width direction W transferred at the secondary transfer portion. That is, the registration roller pair 7 shifts the sheet S in the second direction W2 while conveying the sheet S in the conveyance direction V such that the position of the sheet corresponds to the position of the image in the width direction W formed by the image forming unit 513 (refer to FIG. 1).

Thereby, in the sheet alignment apparatus 10, the position of the sheet S in the width direction W having been subjected to skew correction is corrected to correspond to the position of the image in the width direction W formed at the image forming unit 513, and the image is formed on the sheet S.

Further according to the sheet alignment apparatus 10, the position of the sheet in the width direction W can be corrected without interference from the obliquely conveying roller pairs 32*a* to 32*c* by correcting the position of the sheet S in the width direction W through the registration roller pair 7 after the obliquely conveying roller pairs 32*a* to 32*c* have been separated. That is, the nip between the obliquely conveying roller pairs 32*a* to 32*c* is released when the position of the side edge Sa of the sheet S is changed by the registration roller pair 7.

The registration roller pair 7 constitutes a position changing portion that is arranged downstream of the obliquely conveying roller pairs 32*a* to 32*c* in the sheet conveyance direction, that is movable in the width direction W while nipping the sheet S, and that is capable of changing the position of the edge portion of the sheet S in the width direction W.

Control Processing in Sheet Alignment Apparatus

Figure 19:
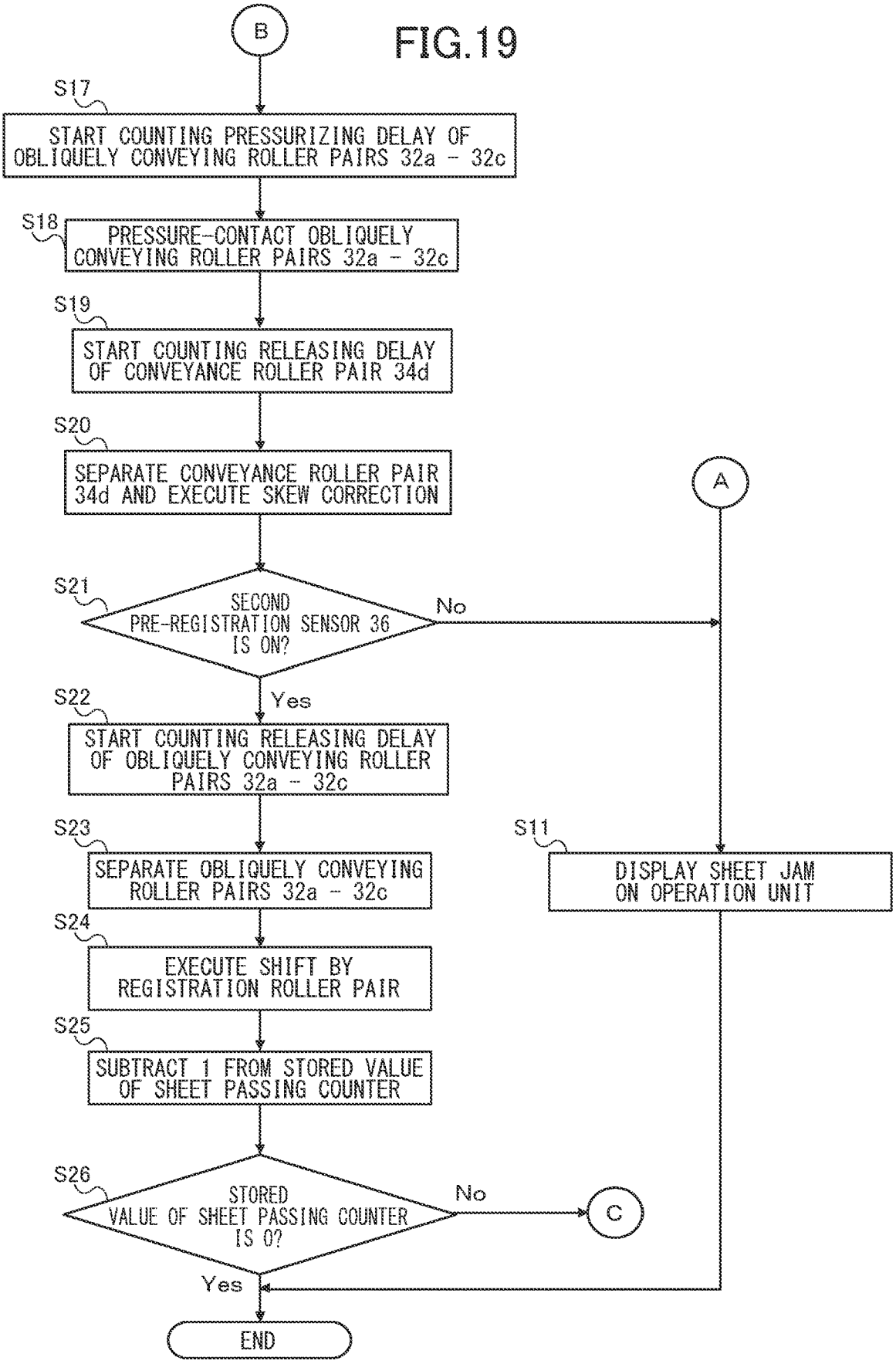
FIG. 19 is a flowchart illustrating a control processing of a case where the CPU of the printing apparatus according to the first embodiment executes registration correction and skew correction.

Next, a control processing executed by the CPU 901 when the sheet alignment apparatus 10 executes the registration correction and the skew correction will be described. FIGS. 18 and 19 are a flowchart illustrating a control processing according to the registration correction and the skew correction performed by the sheet alignment apparatus 10. When the information of the sheet is entered by the operation unit 920 and the job is started, the CPU 901 starts the control processing corresponding to the registration correction and the skew correction by the sheet alignment apparatus 10.

At first, the CPU 901 acquires the information of the sheet, i.e., sheet information, entered from the operation unit 920 (51). In this processing, the CPU 901 acquires the sheet information including a grammage, a size, a number of sheets, and a type of the sheet entered from the operation unit 920. Among the sheet information, the information of the type of the sheet includes the type of the sheet, which is a type chosen among, for example, normal paper used in offices, coated paper, and OHP film which is a transparent sheet. Further, the CPU 901 acquires the number of sheets to be passed through the sheet alignment apparatus 10 in the job being started based on the number of sheets included in the sheet information, and sets the value as an initial value of a stored value which is a value stored in a sheet passing counter.

Next, the CPU 901 determines a nipping pressure of the obliquely conveying roller pairs 32*a* to 32*c* (S2). In this processing, the CPU 901 acquires a table data associating a nipping pressure with the type of sheet set in advance from the rom 903 based on the sheet information acquired in the processing of step S1, and determines the nipping pressure of the obliquely conveying roller pairs 32*a* to 32*c*.

Next, in the image forming apparatus 1, formation of image by the image forming unit 513 is started (S3). The CPU 901 starts counting of a sheet-feed start delay using a timing at which the processing of step S3 is started as reference (S4). The sheet-feed start delay is a time difference between a time elapsed from the forming of image on the intermediate transfer belt 506 to the conveyance thereof to the secondary transfer portion 40 and a time elapsed from the conveyance of the sheet from the sheet feeding apparatus 51 to the secondary transfer portion 40. The CPU 901 sets a value to be counted as the sheet-feed delay according to the image started to be formed by the processing of step S3 in the image forming apparatus 1, and starts counting.

The CPU 901 starts feeding of sheets from the sheet feeding apparatus 51 at a timing at which the count of the sheet-feed start delay has reached the set value (S5). Next, the CPU 901 determines whether the sheet fed from the sheet feeding apparatus 51 is a sheet whose position of the side edge Sa is detectable by the side edge detection apparatus 60 (S6). In this processing, the CPU 901 determines whether the sheet being fed is a transparent sheet, such as an OHP sheet, from the sheet information acquired by the processing of step S1.

In the processing of step S6, if it is determined that the sheet is a non-transparent sheet and detectable by the side edge detection apparatus 60 (Yes), the CPU 901 causes the side edge detection apparatus 60 to detect the side edge position of the sheet at a timing at which the sheet has reached the side edge detection apparatus 60 (S7). In this processing, the CPU 901 causes the side edge detection apparatus 60 to detect the side edge position of the sheet. Next, the CPU 901 calculates the shift amount of the sheet (S8). In this processing, based on the detection result of the side edge detection apparatus 60, the CPU 901 calculates the amount of deviation of the side edge position being detected with respect to the side edge position when the center of the sheet conveyance path in the width direction W and the center of the sheet S in the width direction W correspond. Then, the CPU 901 determines the calculated amount of deviation as the shift amount for shifting the conveyance roller pair 34*d* such that the center of the sheet conveyance path in the width direction W and the center of the sheet S in the width direction W correspond.

In the processing of step S6, if it is determined that the sheet is a transparent sheet that is undetectable by the side edge detection apparatus 60 (No), the CPU 901 determines not to detect the side edge position of the sheet by the side edge detection apparatus 60 (S9).

After executing the processing of steps S8 and S9, the CPU 901 determines whether the first pre-registration sensor 35 has been turned ON (S10). In this processing, based on the signal from the first pre-registration sensor 35, the CPU 901 determines whether the sheet whose side edge position has been detected by the side edge detection apparatus 60 has reached the first pre-registration sensor 35.

In the processing of step S10, if it is determined that the first pre-registration sensor 35 has not been turned ON (No), the CPU 901 determines that sheet jam has occurred, since the sheet has not been conveyed at a timing at which it should be conveyed to the first pre-registration sensor 35. The CPU 901 displays on the operation unit 920 that sheet jam has occurred (S11), and ends the control processing related to the registration correction and skew correction.

Meanwhile, if it is determined that the first pre-registration sensor 35 has been turned ON (Yes), the CPU 901 starts counting of a releasing delay of the conveyance roller pairs 34*a* to 34*c* (S12). At a point of time when the processing of step S12 is executed, in the sheet alignment apparatus 10, the sheet has reached the first pre-registration sensor 35 positioned downstream in the conveyance direction of the conveyance roller pair 34*d*, and registration correction by the conveyance roller pair 34*d* is enabled. Therefore, in the processing of step S12, the CPU 901 sets the value of releasing delay, which is a time elapsed from the nipping state to the nipping release state of the conveyance roller pairs 34*a* to 34*c*, and counting is started.

At a timing at which the processing of step S12 is executed, the CPU 901 separates the drive roller 13 and the driven roller 14 of the conveyance roller pairs 34*a* to 34*c* (S13). Thereby, in the sheet alignment apparatus 10, the sheet is nipped by the conveyance roller pair 34*d* and not nipped by the conveyance roller pairs 34*a* to 34*c*.

At a timing at which the processing of step S13 has been executed and the releasing delay count has reached a set value, the CPU 901 determines whether the sheet fed from the sheet feeding apparatus 51 is a sheet whose position of the side edge Sa is detectable by the side edge detection apparatus 60 (S14). In this processing, the CPU 901 executes a similar processing as the processing of step S6.

In the processing of step S14, if it is determined that the sheet is a non-transparent sheet and detectable by the side edge detection apparatus 60 (Yes), the CPU 901 shifts the conveyance roller pair 34*d* according to a shift amount corresponding to the detection result of the side edge detection apparatus 60 (S15). In this processing, the CPU 901 shifts the conveyance roller pair 34*d* by a shift amount calculated by the processing of step S8, and executes a registration correction in which the position of the sheet is corrected such that the distance from the abutment surface 31*a* of the abutment member 31 to the side edge Sa of the sheet is set to a first distance. In other words, in step S15, the CPU 901 moves the conveyance roller pair 34*d* in the width direction W based on the detection result of the side edge detection apparatus 60 in a state where the conveyance roller pair 34*d* is nipping the sheet and before the sheet S arrives at the obliquely conveying roller pairs 32*a* to 32*c*.

According to this configuration, when conveying the type of sheet detectable by the side edge detection apparatus 60, the sheet alignment apparatus 10 according to the first embodiment can shorten the distance between the side edge Sa of the sheet and the abutment surface 31*a* of the abutment member 31 to a first distance by registration correction. Thereby, the sheet alignment apparatus 10 can reduce the dispersion of conveyance speed of the sheet in skew correction executed after the registration correction, and reduce the effect of skew correction on productivity.

Meanwhile, in the processing of step S14, if it is determined that the sheet is a transparent sheet that is undetectable by the side edge detection apparatus 60 (No), the CPU 901 shifts the conveyance roller pair 34*d* for a predetermined shift amount X set in advance (refer to FIG. 15A) (S16). In this processing, the CPU 901 executes a registration correction of shifting the conveyance roller pair 34*d* for a predetermined shift amount X, i.e., second distance, regardless of the detection result of the side edge detection apparatus 60. In other words, in step S16, the CPU 901 moves the conveyance roller pair 34*d* to the second direction W2 for the shift amount X, regardless of the detection result of the side edge detection apparatus 60, in a state where the conveyance roller pair 34*d* is nipping the sheet and before the sheet arrives at the obliquely conveying roller pairs 32*a* to 32*c*. Thereby, the sheet S is shifted in the second direction W2 corresponding to the shift amount X. That is, the CPU 901 can be described as being capable of executing a first mode in which step S15 is executed and a second mode in which step S16 is executed. The first mode is executed when conveying a type of sheet whose side edge Sa of the sheet S is detectable by the side edge detection apparatus 60, such as normal paper, and the second mode is executed when conveying a type of sheet whose side edge Sa of the sheet S is undetectable by the side edge detection apparatus 60, such as a transparent sheet.

According to this configuration, when a type of sheet undetectable by the side edge detection apparatus 60 is conveyed in the sheet alignment apparatus 10 of the first embodiment, collision of the leading edge Sb of the sheet in the conveyance direction V against the abutment member 31 can be prevented by registration correction. Further, in the sheet alignment apparatus 10, since skewing of the sheet can be corrected by registration correction not only for the type of sheet detectable by the side edge detection apparatus 60 but also for the type of sheet undetectable thereby, such that skewing of the sheet can be corrected stably regardless of sheet type.

After executing the processing of steps S15 and S16, the CPU 901 starts counting of a pressurizing delay of the obliquely conveying roller pairs 32*a* to 32*c* (S17). At a point of time when the processing of step S17 is executed, the registration correction of the sheet has been completed in the sheet alignment apparatus 10. In the sheet alignment apparatus 10, the obliquely conveying roller pairs 32*a* to 32*c* are in a nipping release state so as to prevent the obliquely conveying roller pairs 32*a* to 32*c* from interfering with the registration correction performed by the conveyance roller pair 34*d*. Therefore, in the processing of step S17, the CPU 901 sets a pressurizing delay value which is the time elapsed from the nipping release state to the nipping state of the obliquely conveying roller pairs 32*a* to 32*c*, and starts counting.

At a timing at which the processing of step S17 is executed, the CPU 901 causes the drive rollers 320*a* to 320*c* and the driven rollers 331*a* to 331*c* of the obliquely conveying roller pairs 32*a* to 32*c* to be in pressure-contact with each other (S18). Next, the CPU 901 starts counting a releasing delay which is the time required for the conveyance roller pair 34*d* to change from the nipping state to the nipping release state (S19), and separates the drive roller 402 and the driven roller 401 of the conveyance roller pair 34*d* (S20).

In the sheet alignment apparatus 10, by having the processing of steps S17 to S20 executed, sheets will not be nipped by the conveyance roller pair 34*d*, such that nipping and conveying of sheet by the obliquely conveying roller pairs 32*a* to 32*c* is made possible. In the sheet alignment apparatus 10, by having the sheets nipped and conveyed by the obliquely conveying roller pairs 32*a* to 32*c*, skew correction of the sheet is performed in which the side edge Sa of the sheet is conveyed while being abutted against the abutment surface 31*a* of the abutment member 31.

Next, the CPU 901 determines whether the second pre-registration sensor 36 has been turned ON (S21). In this processing, based on the signals from the second pre-registration sensor 36, the CPU 901 determines whether the sheet subjected to skew correction by the obliquely conveying roller pairs 32*a* to 32*c* has reached the second pre-registration sensor 36.

In the processing of step S21, if it is determined that the second pre-registration sensor 36 has not been turned ON (No), the CPU 901 determines that sheet jamming has occurred since the sheet is not conveyed at a timing at which the sheet should be conveyed to the second pre-registration sensor 36. The CPU 901 displays on the operation unit 920 that sheet jamming has occurred (S11), and ends the control processing regarding the registration correction and the skew correction.

Meanwhile, if it is determined that the second pre-registration sensor 36 has been turned ON (Yes), the CPU 901 starts counting of the releasing delay of the obliquely conveying roller pairs 32*a* to 32*c* (S22). At a point of time at which the processing of step S22 is executed in the sheet alignment apparatus 10, the sheet has reached the second pre-registration sensor 36 which is positioned downstream of the obliquely conveying roller pairs 32*a* to 32*c* in the conveyance direction, such that conveyance of sheets and shifting by the registration roller pair 7 is enabled. Therefore, in the processing of step S22, the CPU 901 sets the value of the releasing delay, which is an elapsed time from the nipping state to the nipping release state of the obliquely conveying roller pairs 32*a* to 32*c*, and starts the counting.

At a timing at which the processing of step S22 is executed, the CPU 901 separates the drive rollers 320*a* to 320*c* and the driven rollers 331*a* to 331*c* of the obliquely conveying roller pairs 32*a* to 32*c* (S23). Thereby, in the sheet alignment apparatus 10, a sheet is nipped by the registration roller pair 7 and not nipped by the obliquely conveying roller pairs 32*a* to 32*c*.

Next, the CPU 901 shifts the position of the sheet in the width direction W by the registration roller pair 7 such that the position of the sheet in the width direction W corresponds to the position of the image in the width direction W transferred at the secondary transfer portion (S24). In this processing, the CPU 901 shifts the position of the sheet nipped by the registration roller pair 7 in the width direction W to a position corresponding to the center position of the image formed by the image forming unit 513 in the width direction W.

Next, the CPU 901 subtracts 1 from a number of passed sheets counted by the sheet passing counter (S25). In this processing, the CPU 901 subtracts a stored value of the sheet passing counter by value "1" corresponding to one sheet, since the registration correction, the skew correction, and the shifting of position of the sheet in the width direction W by the registration roller pair 7 has been completed for one sheet.

Next, the CPU 901 determines whether the stored value of the sheet passing counter is 0 (S26). In this processing, if it is determined that the stored value of the sheet passing counter is not 0 (No), the CPU 901 returns the processing to step S3 to execute the registration correction and the skew correction of the subsequently conveyed sheet of the current job. Meanwhile, if it is determined that the stored value of the sheet passing counter is 0 (Yes), the CPU 901 determines that the registration correction and the skew correction of the sheet in the current job has been completed, and ends the control processing regarding the registration correction and the skew correction.

Summary of First Embodiment

As described above, according to the sheet alignment apparatus 10 of the first embodiment, registration correction based on the detection result of the side edge detection apparatus 60 is performed when the sheet being conveyed is a type of sheet detectable by the side edge detection apparatus 60. The sheet alignment apparatus 10 executes a registration correction in which the conveyance roller pair 34*d* is shifted according to a shift amount based on the detection result, and position of the sheet is corrected to a position where the distance from the abutment surface 31*a* of the abutment member 31 to the side edge Sa of the sheet is set to a first distance.

According to this configuration, in the sheet alignment apparatus 10 according to the first embodiment, when a type of sheet detectable by the side edge detection apparatus 60 is conveyed, the distance between the side edge Sa of the sheet and the abutment surface 31*a* of the abutment member 31 can be sufficiently shortened by the registration correction. Thereby, in the sheet alignment apparatus 10, the dispersion of conveyance speed of the sheets during skew correction that is executed after the registration correction can be reduced and the effect of skew correction on productivity can be cut down.

Further, in the sheet alignment apparatus 10, when the sheet being conveyed is a type of sheet undetectable by the side edge detection apparatus 60, a registration control is performed to shift the conveyance roller pair 34*d* for a predetermined shift amount X set in advance. The sheet alignment apparatus 10 executes a registration correction in which the conveyance roller pair 34*d* and the sheet S are shifted for a predetermined shift amount X. After executing the registration correction, the sheet alignment apparatus 10 executes a skew correction of the sheet by conveying the sheet using the obliquely conveying roller pairs 32*a* to 32*c* such that the side edge Sa of the sheet is aligned with the abutment surface 31*a* of the abutment member 31.

According to such a configuration, the sheet alignment apparatus 10 of the first embodiment can prevent the leading edge Sb of the sheet in the conveyance direction V from colliding against the abutment member 31 by performing registration correction for the type of sheet undetectable by the side edge detection apparatus 60. Further, the sheet alignment apparatus 10 can correct the skewing of the sheet by performing registration correction not only for the type of sheet detectable by the side edge detection apparatus 60 but also for the type of sheet undetectable thereby, such that the skewing of the sheet can be corrected stably regardless of the type of sheet.

Second Embodiment

Next, the sheet alignment apparatus 10 according to a second embodiment will be described. The sheet alignment apparatus 10 according to the second embodiment is configured to shift the abutment member 31 for a predetermined shift amount in the width direction W when performing registration correction of a sheet whose side edge Sa is undetectable by the side edge detection apparatus 60. In this configuration, the sheet alignment apparatus 10 according to the second embodiment differs from the first embodiment described above. The other configurations are similar to the first embodiment, such that components common to the first embodiment are denoted with the same reference numbers and control processing common to the first embodiment are denoted with the same step numbers, and descriptions thereof are omitted.

Registration Correction by Sheet Alignment Apparatus

Figure 20A:
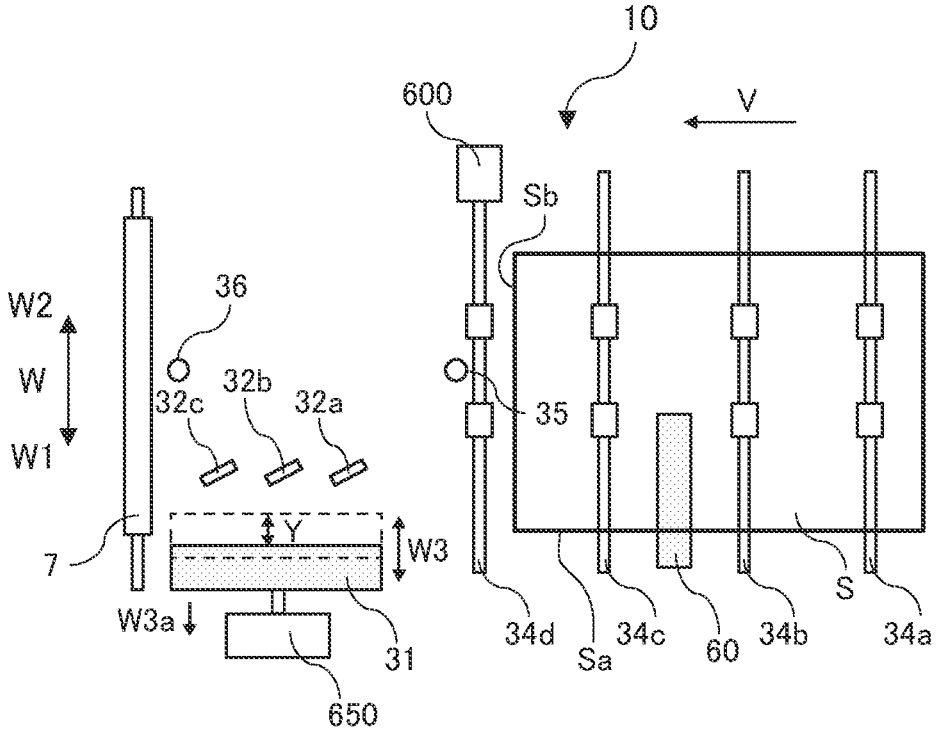
FIG. 20A is a top view illustrating a state in which registration correction is executed in a case where a sheet having a side edge undetectable by a side edge detection apparatus of a sheet alignment apparatus according to a second embodiment is conveyed.
Figure 20B:
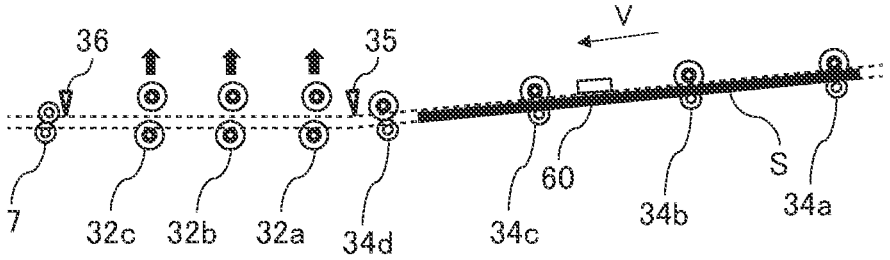
FIG. 20B is a cross-sectional view of the state illustrated in FIG. 20A.

FIG. 20A is a top view illustrating a state in which a transparent sheet whose side edge position is undetectable by the side edge detection apparatus 60 is conveyed and registration correction has been executed thereto in the sheet alignment apparatus 10 according to the second embodiment. FIG. 20B is a cross-sectional view of the state illustrated in FIG. 20A. As illustrated in FIGS. 20A and 20B, the sheet alignment apparatus 10 includes a shift portion 650 in which the abutment member 31 is shifted in the width direction W. The shift portion 650 serving as a second moving unit is configured to be able to shift in the width direction W illustrated in FIG. 20A by a shift drive motor and a transmission gear not shown.

The CPU 901 performs registration correction by the conveyance roller pair 34*d*, similar to the first embodiment, in a case where the type of sheet being conveyed is a type of sheet detectable by the side edge detection apparatus 60. In the sheet alignment apparatus 10, the conveyance roller pair 34*d* is shifted by the shift portion 600 such that the distance from the abutment surface 31*a* of the abutment member 31 to the side edge Sa of the sheet S that is nipped by the conveyance roller pair 34*d* and that is detectable by the side edge detection apparatus 60 is set to a third distance, for example, 4 mm.

Next, a registration correction performed to a sheet whose side edge Sa is undetectable by the side edge detection apparatus 60 will be described. The sheet alignment apparatus 10 according to the second embodiment is configured such that the abutment member 31 is shifted for a predetermined shift amount Yin a first direction W1 when information indicating that the sheet is a transparent sheet is entered from the operation unit 920 (refer to FIG. 12).

The sheet alignment apparatus 10 performs a registration correction of shifting the abutment member 31 for the predetermined shift amount Y in the first direction W1 regardless of the detection result of the side edge detection apparatus 60 in a state where the conveyance roller pairs 34*a* to 34*d* are in a nipping state. In other words, the CPU 901 controls the shift portion 650 such that the abutment member 31 moves for the predetermined shift amount Y serving as a fourth distance in the first direction W1 away from the sheet S nipped by the conveyance roller pairs 34*a* to 34*d*. The nipping of the conveyance roller pairs 34*a* to 34*c* is released when the conveyance roller pair 34*d* moves in the width direction W while nipping the sheet S, and is not released when the abutment member 31 moves in the first direction W1.

In a case where the type of the sheet S has a transparency that is undetectable by the side edge detection apparatus 60, the sheet alignment apparatus 10 performs registration correction in which the abutment member 31 shifts in the first direction W1 until the sheet S conveyed by the conveyance roller pairs 34*a* to 34*d* reaches the abutment member 31.

According to this configuration, in a case where the type of the sheet S is undetectable by the side edge detection apparatus 60, the sheet alignment apparatus 10 can carry out the registration correction without performing a control to release the nipping of the conveyance roller pairs 34*a* to 34*d* prior to performing registration correction in a case where the type of the sheet S is undetectable by the side edge detection apparatus 60. Thereby, in a case where the type of the sheet S is a type undetectable by the side edge detection apparatus 60, the sheet alignment apparatus 10 enables to prevent the leading edge Sb of the sheet S in the conveyance direction V from colliding against the abutment member 31 due to the registration correction by a simple sequence.

Control Processing by Sheet Alignment Apparatus

Figure 21:
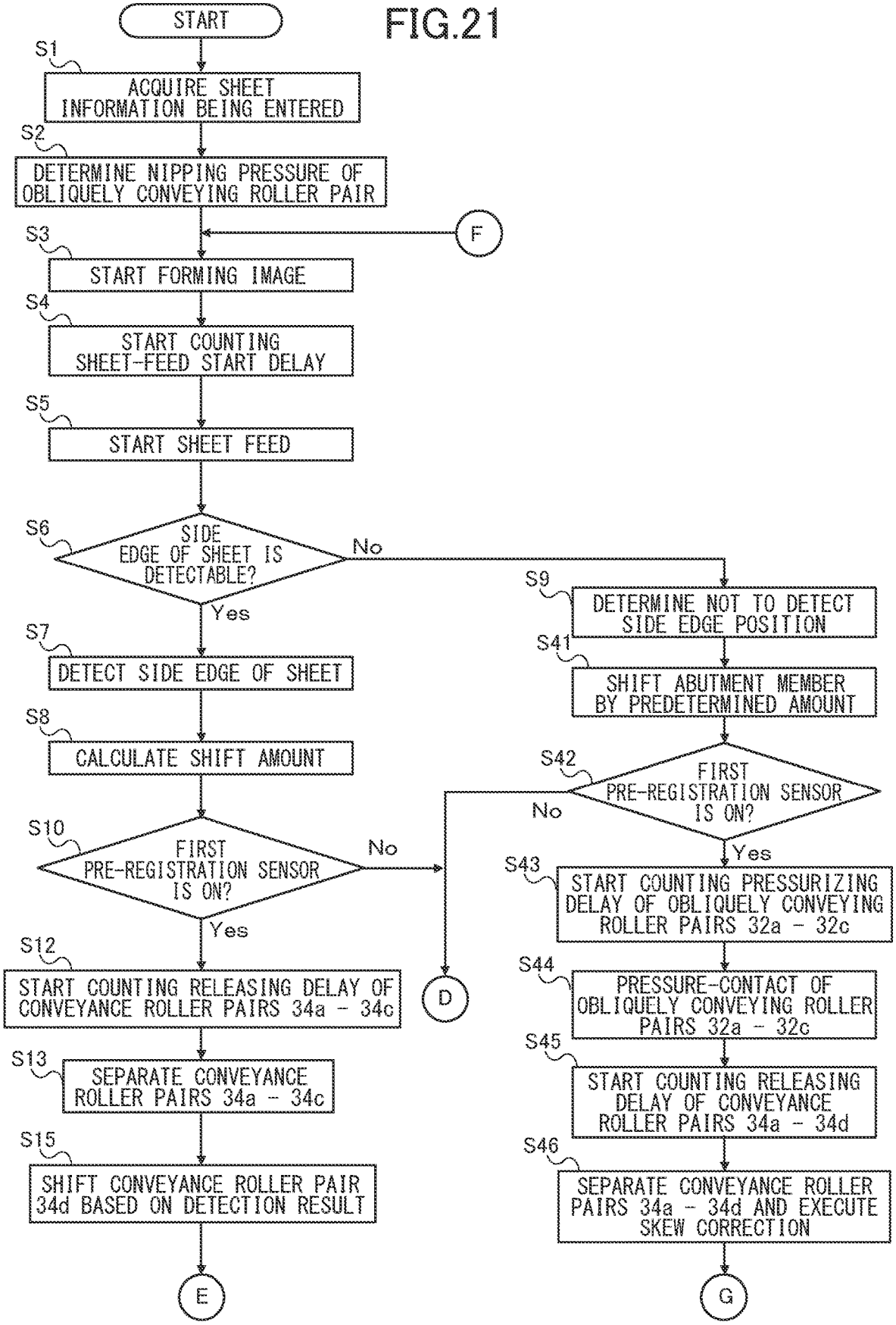
FIG. 21 is a flowchart illustrating a control processing of a case where a CPU of a printing apparatus according to a second embodiment executes registration correction and skew correction.
Figure 22:
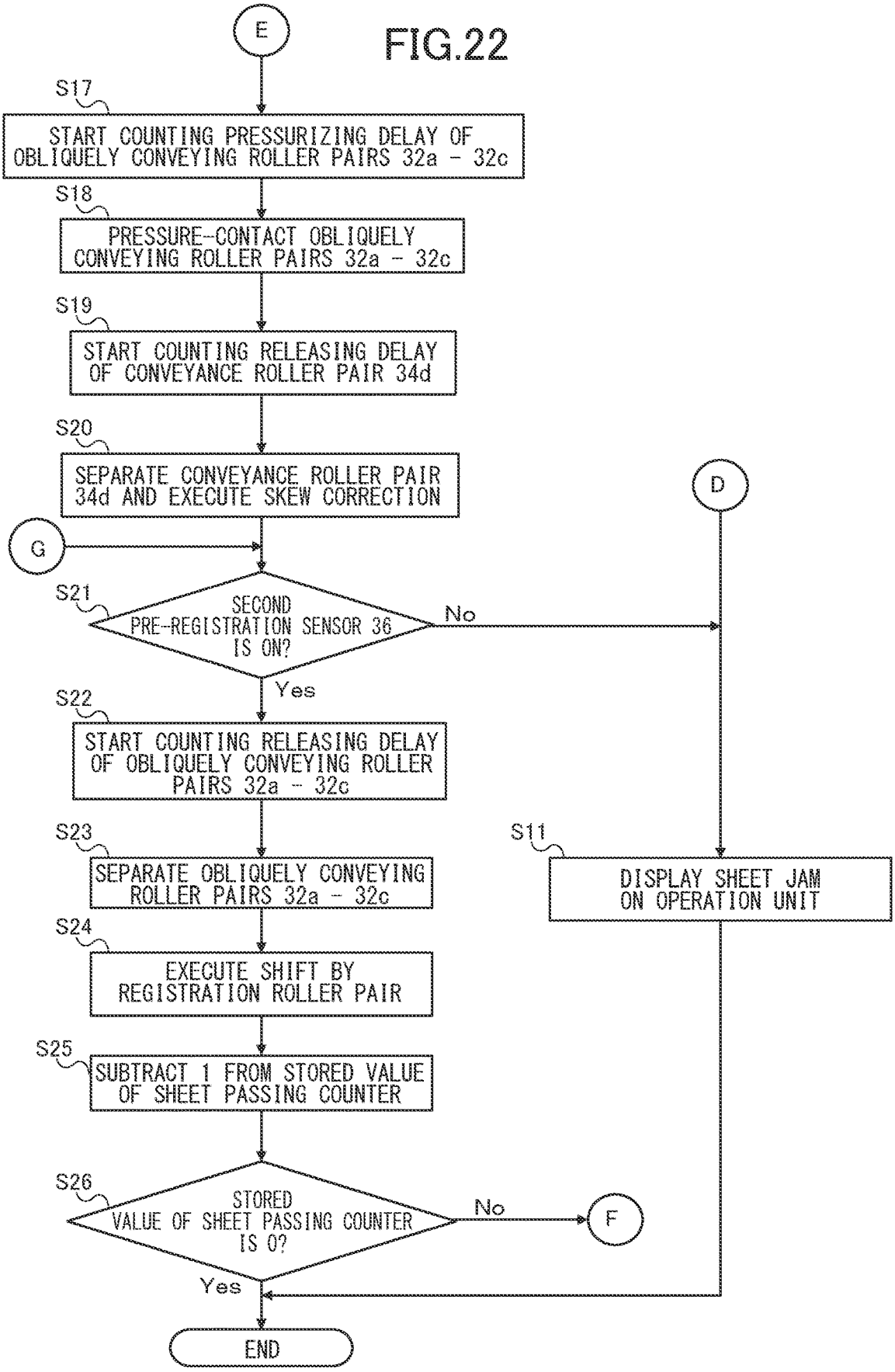
FIG. 22 is a flowchart illustrating the control processing of a case where the CPU of the printing apparatus according to the second embodiment executes registration correction and skew correction.

Next, the control processing performed by the CPU 901 when the sheet alignment apparatus 10 executes registration correction and skew correction will be described. FIGS. 21 and 22 are flowcharts illustrating a control processing according to the registration correction and the skew correction by the sheet alignment apparatus 10. The CPU 901 starts the control processing according to registration correction and skew correction by the sheet alignment apparatus 10 based on the input of sheet information by the operation unit 920 and the starting of the job.

After executing the processing of step S5, the CPU 901 determines whether the sheet fed from the sheet feeding apparatus 51 is a sheet whose position of the side edge Sa is detectable by the side edge detection apparatus 60 (S6). In this processing, the CPU 901 determines whether the sheet being fed is a transparent sheet such as an OHP sheet based on the sheet information acquired by the processing of step S1.

In the processing of step S6, if the sheet is determined to be a non-transparent sheet that is detectable by the side edge detection apparatus 60 (Yes), and the processing of steps S7 and S8 are executed, the CPU 901 determines whether the first pre-registration sensor 35 has been turned ON (S10). In this processing, the CPU 901 determines whether the sheet whose side edge position is detected by the side edge detection apparatus 60 has reached the first pre-registration sensor 35 based on the signal from the first pre-registration sensor 35.

In the processing of step S10, if it is determined that the first pre-registration sensor 35 has not been turned ON (No), the CPU 901 determines that sheet jam has occurred since the sheet has not been conveyed to the first pre-registration sensor 35 at a timing that it should be conveyed thereto. The CPU 901 displays on the operation unit 920 that sheet jam has occurred (S11), and ends the control processing according to the registration correction and the skew correction.

Meanwhile, if it is determined that the first pre-registration sensor 35 has been turned ON (Yes), the CPU 901 executes the processing of steps S12 and S13, such that the sheet is nipped by the conveyance roller pair 34*d* and not nipped by the conveyance roller pairs 34*a* to 34*c*. After executing the processing of step S13, the CPU 901 of the second embodiment shifts the conveyance roller pair 34*d* by a shift amount corresponding to the detection result of the side edge detection apparatus 60 (S15). In other words, after executing the processing of step S13, the CPU 901 of the second embodiment executes the processing of step S15 without executing the processing of step S14 of determining whether the sheet being fed is a sheet whose position of the side edge Sa is detectable by the side edge detection apparatus 60.

In the processing of step S15, the CPU 901 executes a registration correction of shifting the conveyance roller pair 34*d* for a shift amount calculated by the processing of step S8 and correcting the position such that the distance from the abutment surface 31*a* of the abutment member 31 to the side edge Sa of the sheet is set to a third distance. In the second embodiment, the CPU 901 causes the shift portion 600 to shift the conveyance roller pair 34*d* such that the third distance becomes 4 mm, for example.

According to this configuration, when conveying a type of sheet detectable by the side edge detection apparatus 60, the sheet alignment apparatus 10 according to the second embodiment can shorten the distance between the side edge Sa of the sheet and the abutment surface 31*a* of the abutment member 31 to the third distance by the registration correction. Thereby, the sheet alignment apparatus 10 can reduce the dispersion of conveyance speed of the sheet by skew correction that is executed after the registration correction, and reduce the effect of skew correction on productivity.

After executing the processing of step S15, the CPU 901 executes the processing of steps S17 to S20, nips and conveys the sheet by the obliquely conveying roller pairs 32*a* to 32*c*, and causes the side edge Sa of the sheet to be abutted against the abutment surface 31*a* of the abutment member 31 to thereby execute skew correction of the sheet.

Meanwhile, in the processing of step S6, if it is determined that the sheet is a transparent sheet and is undetectable by the side edge detection apparatus 60 (No), the CPU 901 determines not to detect the side edge position of the sheet by the side edge detection apparatus 60 (S9). Next, the CPU 901 shifts the abutment member 31 by the predetermined shift amount Y set in advance (refer to FIG. 20A) (S41). In this processing, the CPU 901 shifts the abutment member 31 in the first direction W1 by the predetermined shift amount Y regardless of the detection result of the side edge detection apparatus 60. By shifting the abutment member 31 in the first direction W1, the CPU 901 corrects the relative position of the sheet and the width direction W of the abutment member 31, and executes a registration correction for preventing the collision of the leading edge Sb of the sheet against the abutment member 31. In the second embodiment, the predetermined shift amount Y is set to 6 mm, for example, and the abutment member 31 moves for a fourth distance, for example, 6 mm.

In other words, in a case where the sheet is a transparent sheet that is undetectable by the side edge detection apparatus 60, the sheet alignment apparatus 10 of the second embodiment is configured to shift the abutment member 31 in the first direction W1 by a fourth distance in a state where the conveyance roller pairs 34*a* to 34*d* is nipping and conveying the sheet. In other words, in step S41, the CPU 901 moves the abutment member 31 for a shift amount Y, i.e., fourth distance, in the second direction W2 regardless of the detection result of the side edge detection apparatus 60 in a state before the sheet S reaches the obliquely conveying roller pairs 32*a* to 32*c*. As mentioned above, the CPU 901 can be described as being capable of executing a third mode of executing step S15 and a fourth mode of executing step S41. The third mode is executed when the type of sheet whose side edge Sa of the sheet S is detectable by the side edge detection apparatus 60, such as normal paper, is conveyed, and the fourth mode is executed when the type of sheet whose side edge Sa of the sheet S is undetectable by the side edge detection apparatus 60, i.e., transparent sheet, is conveyed.

According to this configuration, the sheet alignment apparatus 10 according to the second embodiment can perform the registration correction without executing a process of releasing the nipping of the conveyance roller pairs 34*a* to 34*d* prior to performing the registration correction in a case where the sheet is a transparent sheet. Thereby, in a case where the type of the sheet S is a type undetectable by the side edge detection apparatus 60, the sheet alignment apparatus 10 enables to prevent the leading edge Sb of the sheet S in the conveyance direction V from colliding against the abutment member 31 by a registration correction composed of a simple sequence.

After executing the processing of step S42, the CPU 901 determines whether the first pre-registration sensor 35 has been turned ON (S43). In this processing, the CPU 901 determines whether the sheet whose side edge position has been detected by the side edge detection apparatus 60 has reached the first pre-registration sensor 35 based on the signal from the first pre-registration sensor 35, similar to the processing of step S10.

In the processing of step S43, when it is determined that the first pre-registration sensor 35 has not been turned ON (No), the CPU 901 determines that sheet jam has occurred since the sheet has not been conveyed to the first pre-registration sensor 35 at a timing at which it should be conveyed. The CPU 901 displays on the operation unit 920 that sheet jam has occurred (S11), and ends the control processing according to the registration correction and the skew correction.

Meanwhile, when it is determined that the first pre-registration sensor 35 has been turned ON (Yes), the CPU 901 starts counting of a pressurizing delay of the obliquely conveying roller pairs 32*a* to 32*c* (S43). At a point of time at which the processing of step S43 is executed, the registration correction of the sheet is completed in the sheet alignment apparatus 10. Further, in the sheet alignment apparatus 10, the obliquely conveying roller pairs 32*a* to 32*c* are in a nipping release state so as to prevent the obliquely conveying roller pairs 32*a* to 32*c* from interfering with the nipping and conveying of the sheet by the conveyance roller pairs 34*a* to 34*d*. Therefore, in the processing of step S43, the CPU 901 sets the value of a pressurizing delay, which is a time elapsed from a nipping release state to a nipping state of the obliquely conveying roller pairs 32*a* to 32*c*.

At a timing at which the processing of step S43 is executed, the CPU 901 causes the drive rollers 320*a* to 320*c* and the driven rollers 331*a* to 331*c* of the obliquely conveying roller pairs 32*a* to 32*c* to be in pressure-contact with each other (S44). Next, the CPU 901 starts counting of a releasing delay, which is a time for the conveyance roller pairs 34*a* to 34*d* to change from the nipping state to the nipping release state (S45). Then, the CPU 901 separates the drive roller 13 and the driven roller 14 of the conveyance roller pairs 34*a* to 34*c* and separates the drive roller 402 and the driven roller 401 of the conveyance roller pair 34*d* (S46).

By having the processes of steps S43 to S46 executed in the sheet alignment apparatus 10, the sheet is not nipped by the conveyance roller pairs 34*a* to 34*d*, and the nipping and conveying of the sheet by the obliquely conveying roller pairs 32*a* to 32*c* is enabled. In the sheet alignment apparatus 10, since the sheet is nipped and conveyed by the obliquely conveying roller pairs 32*a* to 32*c*, a skew correction of the sheet is performed in which the sheet is conveyed while having the side edge Sa of the sheet abutted against the abutment surface 31*a* of the abutment member 31.

After executing the processing of steps S20 and S46, the CPU 901 executes the processing of steps S21 to S26, similar to the control processing when executing the registration correction and the skew correction according to the first embodiment. In the processing of step S26, when the CPU 901 determines that the stored value of the sheet passing counter is not 0 (No), the CPU 901 returns the processing to step S3 to execute the registration correction and the skew correction of the subsequently conveyed sheet of the current job. Meanwhile, if it is determined that the stored value of the sheet passing counter is 0 (Yes), the CPU 901 determines that the registration correction and the skew correction to the sheet in the current job has been completed, and ends the control processing regarding the registration correction and the skew correction.

Summary of Second Embodiment

As described above, according to the sheet alignment apparatus 10 of the second embodiment, registration correction based on the detection result of the side edge detection apparatus 60 is performed when the sheet being conveyed is a type of sheet detectable by the side edge detection apparatus 60. The sheet alignment apparatus 10 executes a registration correction in which the conveyance roller pair 34*d* is shifted according to a shift amount based on the detection result, and the position of the sheet is corrected to a position where the distance from the abutment surface 31*a* of the abutment member 31 to the side edge Sa of the sheet is set to a third distance.

According to this configuration, in the sheet alignment apparatus 10 according to the second embodiment, when a type of sheet detectable by the side edge detection apparatus 60 is conveyed, the distance between the side edge Sa of the sheet and the abutment surface 31*a* of the abutment member 31 can be shortened sufficiently by the registration correction. Thereby, in the sheet alignment apparatus 10, the dispersion of conveyance speed of the sheets during skew correction that is executed after the registration correction can be reduced and the effect of skew correction on productivity can be cut down.

Further, in the sheet alignment apparatus 10, when the sheet being conveyed is a type of sheet undetectable by the side edge detection apparatus 60, a registration control is performed to shift the abutment member 31 in the first direction W1 for a predetermined shift amount Y set in advance.

According to such configuration, the sheet alignment apparatus 10 of the second embodiment can perform the registration correction without executing a process of releasing the nipping of the conveyance roller pairs 34*a* to 34*d* prior to performing registration correction in a case where the sheet is a transparent sheet. Thereby, in a case where the type of the sheet S is a type undetectable by the side edge detection apparatus 60, the sheet alignment apparatus 10 can prevent the leading edge Sb of the sheet S in the conveyance direction V from colliding against the abutment member 31 due to the registration correction by a simple sequence.

After executing the registration correction, the sheet alignment apparatus 10 executes the skew correction of the sheet by conveying the sheet by the obliquely conveying roller pairs 32*a* to 32*c* such that the side edge Sa of the sheet is aligned with the abutment surface 31*a* of the abutment member 31.

As described, the sheet alignment apparatus 10 can correct the skewing of the sheet by performing registration correctio not only for the type of sheet detectable by the side edge detection apparatus 60 but also for the type of sheet undetectable thereby, such that the skewing of the sheet can be corrected stably regardless of the type of sheet.

OTHER EMBODIMENTS

In the second embodiment, the sheet alignment apparatus 10 executes the registration correction using the conveyance roller pair 34*d* in a case where the type of sheet is a type of sheet detectable by the side edge detection apparatus 60, but the present technique is not limited thereto. The sheet alignment apparatus 10 can also be configured to execute a registration correction of shifting the abutment member 31 in a case where the type of sheet is a type of sheet detectable by the side edge detection apparatus 60. The sheet alignment apparatus 10 moves the abutment member 31 to the shift portion 650 based on the detection result of the side edge detection apparatus 60 such that the distance from the abutment surface 31*a* to the side edge Sa of the sheet nipped by the conveyance roller pairs 34*a* to 34*d* is set to a third distance.

Further, the CPU 901 can be configured to execute first to fourth processing described below. A first processing is a processing of controlling the shift portion 600 such that the conveyance roller pair 34*d* nipping the sheet moves in the width direction W based on a detection result of the side edge detection apparatus 60. A second processing is a processing of controlling the shift portion 650 such that the abutment member 31 moves in the width direction W based on a detection result of the side edge detection apparatus 60. A third processing is a processing of controlling the shift portion 600 such that the conveyance roller pair 34*d* nipping the sheet S moves in the second direction W2 regardless of the detection result of the side edge detection apparatus 60. A fourth processing is a processing of controlling the shift portion 650 such that the abutment member 31 moves in the first direction W1 regardless of the detection result of the side edge detection apparatus 60. The CPU 901 may be configured to be able to execute a fifth mode of executing at least either one of the first processing and the second processing, and a sixth mode of executing at least either one of the third processing and the fourth processing. That is, the CPU 901 can execute both or either one of the first processing and the second processing in the fifth mode, and can execute both or either one of the third processing and the fourth processing in the sixth mode. The fifth mode is executed in a case where the sheet being conveyed is the first type, and the sixth mode is executed in a case where the sheet being conveyed is the second type.

According to this configuration, the sheet alignment apparatus 10 can perform the registration correction by the shift portion 650 of moving the abutment member 31 regardless of the type of sheet, without providing a configuration for registration correction in the conveyance roller pair 34*d*. Therefore, the sheet alignment apparatus 10 can correct skewing of the sheet stably regardless of the type of sheet while reducing the number of components used for registration correction.

Further, according to the first and second embodiments, the skew feed correcting portion 55 includes obliquely conveying roller pairs 32*a* to 32*c* that are respectively inclined by angle θ with respect to the abutment surface 31*a*, but the present technique is not limited thereto. The skew feed correcting portion 55 can be configured such that inclination angles against the abutment surface 31*a* are set to different angles for each of the plurality of obliquely conveying roller pairs. Specifically, the skew feed correcting portion 55 can be configured such that, among first to third obliquely conveying roller pairs, a first obliquely conveying roller pair is arranged to be inclined by angle α with respect to the abutment surface, and a second obliquely conveying roller pair is arranged to be inclined by angle β with respect to the abutment surface. Further, the skew feed correcting portion 55 can be configured such that the third obliquely conveying roller pair is arranged to be inclined by angle γ with respect to the abutment surface.

Further according to the first and second embodiments, the skew feed correcting portion 55 rotates the respective drive rollers of the obliquely conveying roller pairs 32*a* to 32*c* by transmitting the driving force of the obliquely conveying drive motor Ms1 via the pulley 322 and the conveying belt 323, but the present technique is not limited thereto. The skew feed correcting portion 55 is configured to supply driving force from different driving motors to each drive roller of the obliquely conveying roller pairs 32*a* to 32*c*.

Further according to the first and second embodiments, the sheet alignment apparatus 10 has four conveyance roller pairs provided on the conveyance roller portion 50 and three obliquely conveying roller pairs provided on the skew feed correcting portion 55, but the number of roller pairs is not limited.

Further according to the first and second embodiments, the sheet alignment apparatus 10 sets the type of sheet having a transparency whose position of the width-direction edge portion of the sheet is undetectable by the side edge detection apparatus 60 as the second type of sheet, but the present technique is not limited thereto. The sheet alignment apparatus 10 should merely be configured to have the first type and the second type set in advance. That is, the sheet alignment apparatus 10 may be configured to shift the conveyance roller pair 34*d* or the abutment member 31 by a predetermined shift amount regardless of the transparency of the sheet if the sheet is a second type. For example, a tab sheet in which the side edge Sa of the sheet S is not extended uniformly in the conveyance direction V can be set as the second type of sheet.

Further according to the first and second embodiments, the sheet alignment apparatus 10 is configured to determine that the sheet is a second type by acquiring information entered from the operation unit 920 indicating that the sheet is a transparent sheet, but the present technique is not limited thereto. For example, the sheet alignment apparatus 10 may be configured to determine that the sheet is a second type in a case where the leading edge Sb of the sheet is detected by the first pre-registration sensor 35 and the position of the side edge Sa of the sheet is not detected by the side edge detection apparatus 60.

Further, the sheet alignment apparatus 10 is configured such that the first distance according to the first embodiment and the third distance according to the second embodiment are both set to 4 mm, but the present technique is not limited thereto, and the first distance and the third distance may be set arbitrarily.

Further, the sheet alignment apparatus 10 is configured such that the second distance according to the first embodiment and the fourth distance according to the second embodiment are both set to 6 mm, but the present technique is not limited thereto, and the second distance and the fourth distance may be set arbitrarily.

In the first embodiment, the sheet alignment apparatus 10 is configured such that the second distance is longer than the first distance, but the present technique is not limited thereto, and the second distance and the first distance can be the same distance, or the second distance can be shorter than the first distance. Similarly, in the second embodiment, the sheet alignment apparatus 10 is configured such that the fourth distance is longer than the third distance, but the present technique is not limited thereto, and the fourth distance and the third distance can be the same distance, or the fourth distance can be shorter than the third distance.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2022-132012, filed Aug. 22, 2022, which is hereby incorporated by reference herein in its entirety.

What is claimed is:

1. A sheet conveyance apparatus comprising:

a rotary member pair configured to nip and convey a sheet in a sheet conveyance direction;

an actuator configured to move the rotary member pair, nipping the sheet, in a width direction orthogonal to the sheet conveyance direction, the width direction including a first direction from one side in the width direction toward the other side, and a second direction which is opposite to the first direction;

an abutment member arranged downstream of the rotary member pair in the sheet conveyance direction, the abutment member including an abutment surface that extends along the sheet conveyance direction and that is configured to be in contact with a downstream edge of the sheet in the first direction;

an obliquely conveying portion that is arranged downstream of the rotary member pair in the sheet conveyance direction and that conveys the sheet in the first direction while conveying the sheet in the sheet conveyance direction such that the downstream edge approaches the abutment surface;

a detector that is arranged upstream of the obliquely conveying portion in the sheet conveyance direction and that detects a position of the downstream edge; and a control unit configured to control the actuator, wherein the control unit is configured to execute (1) a first mode of controlling the actuator such that the rotary member pair is moved in the width direction based on a detection result of the detector in a state where the sheet is nipped by the rotary member pair and before the sheet arrives at the obliquely conveying portion, and (2) a second mode of controlling the actuator such that the rotary member pair is moved in the second direction regardless of the detection result of the detector in the state where the sheet is nipped by the rotary member pair and before the sheet arrives at the obliquely conveying portion.

2. The sheet conveyance apparatus according to claim 1, wherein the control unit executes the first mode in a case where the sheet being conveyed is a first type, and executes the second mode in a case where the sheet being conveyed is a second type that differs from the first type.

3. The sheet conveyance apparatus according to claim 2, wherein the first type of sheet is a sheet whose position of the downstream edge is detectable by the detector, and wherein the second type of sheet is a sheet, having transparency, whose position of the downstream edge is undetectable by the detector.

4. The sheet conveyance apparatus according to claim 1, wherein, in the first mode, the control unit moves the rotary member pair in the width direction such that a distance between the abutment surface and the downstream edge is set to a first distance based on the detection result of the detector, and wherein, in the second mode, the control unit moves the rotary member pair in the second direction for a second distance regardless of the detection result of the detector.

5. The sheet conveyance apparatus according to claim 4, wherein the second distance is longer than the first distance.

6. The sheet conveyance apparatus according to claim 1, wherein the detector detects the position of the downstream edge of the sheet being nipped by the rotary member pair.

7. The sheet conveyance apparatus according to claim 1, wherein the rotary member pair is a first rotary member pair, wherein the sheet conveyance apparatus further comprises a second rotary member pair that is arranged upstream of the first rotary member pair in the sheet conveyance direction and that is configured to form a nip that nips the sheet, and wherein the nip of the second rotary member pair is released in a case where the first rotary member pair, nipping the sheet, moves in the width direction.

8. The sheet conveyance apparatus according to claim 1, wherein the rotary member pair is configured to form a nip that nips the sheet, and wherein the nip of the rotary member pair is released in a case where the sheet is conveyed by the obliquely conveying portion.

9. The sheet conveyance apparatus according to claim 1, further comprising a position changing portion configured to change a position of the downstream edge of the sheet, the position changing portion being arranged downstream of the obliquely conveying portion in the sheet conveyance direction and being configured to move in the width direction while nipping the sheet, wherein the obliquely conveying portion includes an obliquely conveying rotary member pair configured to form a nip that nips the sheet, and wherein the nip of the obliquely conveying rotary member pair is released in a case where the position changing portion changes the position of the downstream edge of the sheet.

10. An image forming apparatus comprising:

the sheet conveyance apparatus according to claim 1; and an image forming unit configured to form an image on a sheet being conveyed by the sheet conveyance apparatus.

11. A sheet conveyance apparatus comprising:

a rotary member pair configured to nip and convey a sheet in a sheet conveyance direction;

a first actuator configured to move the rotary member pair, nipping the sheet, in a width direction orthogonal to the sheet conveyance direction, the width direction including a first direction from one side in the width direction toward the other side, and a second direction which is opposite to the first direction;

an abutment member arranged downstream of the rotary member pair in the sheet conveyance direction, the abutment member including an abutment surface that extends along the sheet conveyance direction and that is configured to be in contact with a downstream edge of the sheet in the first direction;

a second actuator configured to move the abutment member in the width direction;

an obliquely conveying portion that is arranged downstream of the rotary member pair in the sheet conveyance direction and that conveys the sheet in the first direction while conveying the sheet in the sheet conveyance direction such that the downstream edge approaches the abutment surface;

a detector that is arranged upstream of the obliquely conveying portion in the sheet conveyance direction and that detects a position of the downstream edge; and a control unit configured to control the first actuator and the second actuator, wherein the control unit is configured to execute (1) a third mode of controlling the first actuator such that the rotary member pair is moved in the width direction based on a detection result of the detector in a state where the sheet is nipped by the rotary member pair and before the sheet arrives at the obliquely conveying portion, and (2) a fourth mode of controlling the second actuator such that the abutment member is moved in the first direction regardless of the detection result of the detector before the sheet reaches the obliquely conveying portion.

12. The sheet conveyance apparatus according to claim 11, wherein the control unit executes the third mode in a case where the sheet being conveyed is a first type, and executes the fourth mode in a case where the sheet being conveyed is a second type that differs from the first type.

13. The sheet conveyance apparatus according to claim 12, wherein the first type of sheet is a sheet whose position of the downstream edge is detectable by the detector, and wherein the second type of sheet is a sheet, having transparency, whose position of the downstream edge is undetectable by the detector.

14. The sheet conveyance apparatus according to claim 11, wherein, in the third mode, the control unit moves the rotary member pair in the width direction such that a distance between the abutment surface and the downstream edge is set to a third distance based on the detection result of the detector, and wherein, in the fourth mode, the control unit moves the abutment member in the first direction for a fourth distance regardless of the detection result of the detector.

15. The sheet conveyance apparatus according to claim 14, wherein the fourth distance is longer than the third distance.

16. The sheet conveyance apparatus according to claim 11, wherein the rotary member pair is a first rotary member pair, wherein the sheet conveyance apparatus further comprises a second rotary member pair that is arranged upstream of the first rotary member pair in the sheet conveyance direction and that is configured to form a nip that nips the sheet, wherein the nip of the second rotary member pair is released in a case where the first rotary member pair, nipping the sheet, moves in the width direction, and wherein the nip of the second rotary member pair is not released in a case where the abutment member moves in the first direction.

17. An image forming apparatus comprising:

the sheet conveyance apparatus according to claim 11; and an image forming unit configured to form an image on a sheet being conveyed by the sheet conveyance apparatus.

18. A sheet conveyance apparatus comprising:

a rotary member pair configured to nip and convey a sheet in a sheet conveyance direction;

a first actuator configured to move the rotary member pair, nipping the sheet, in a width direction orthogonal to the sheet conveyance direction, the width direction including a first direction from one side in the width direction toward the other side, and a second direction which is opposite to the first direction;

an abutment member arranged downstream of the rotary member pair in the sheet conveyance direction, the abutment member including an abutment surface that extends along the sheet conveyance direction and that is configured to be in contact with a downstream edge of the sheet in the first direction;

a second actuator configured to move the abutment member in the width direction;

an obliquely conveying portion that is arranged downstream of the rotary member pair in the sheet conveyance direction and that conveys the sheet in the first direction while conveying the sheet in the sheet conveyance direction such that the downstream edge approaches the abutment surface;

a detector that is arranged upstream of the obliquely conveying portion in the sheet conveyance direction and that detects a position of the downstream edge; and a control unit configured to execute, before the sheet arrives at the obliquely conveying portion, (1) a first processing of controlling the first actuator such that the rotary member pair, nipping the sheet, is moved in the width direction based on a detection result of the detector, (2) a second processing of controlling the second actuator such that the abutment member is moved in the width direction based on the detection result of the detector, (3) a third processing of controlling the first actuator such that the rotary member pair, nipping the sheet, is moved in the second direction regardless of the detection result of the detector, and (4) a fourth processing of controlling the second actuator such that the abutment member is moved in the first direction regardless of the detection result of the detector, wherein the control unit is configured to execute a fifth mode in which at least either one of the first processing and the second processing is executed, and execute a sixth mode in which at least either one of the third processing and the fourth processing is executed.

19. The sheet conveyance apparatus according to claim 18, wherein the control unit executes the fifth mode in a case where the sheet being conveyed is a first type, and executes the sixth mode in a case where the sheet being conveyed is a second type that differs from the first type.

20. The sheet conveyance apparatus according to claim 19, wherein the first type of sheet is a sheet whose position of the downstream edge is detectable by the detector, and wherein the second type of sheet is a sheet, having transparency, whose position of the downstream edge is undetectable by the detector.

21. An image forming apparatus comprising:

the sheet conveyance apparatus according to claim 18; and an image forming unit configured to form an image on a sheet being conveyed by the sheet conveyance apparatus.

* * * * *